US006067902A

United States Patent [19]

Takahashi

[11] Patent Number: 6,067,902

[45] Date of Patent: May 30, 2000

[54] STENCIL PRINTER

[75] Inventor: Mituru Takahashi, Shiroishi, Japan

[73] Assignee: Tohoku Ricoh Co., Ltd., Shibata-gun, Japan

[21] Appl. No.: 09/079,287

[22] Filed: May 15, 1998

[30] Foreign Application Priority Data

May 21, 1997 [JP] Japan ..... 9-131428

[51] Int. Cl.[7] ..... B41L 13/00

[52] U.S. Cl. ..... 101/118; 101/115; 101/485

[58] Field of Search ..... 101/114, 115, 101/116, 117, 118, 123, 129, 183, 232, 233, 477, 484, 485; 271/270

[56] References Cited

U.S. PATENT DOCUMENTS

| | | | |
|---|---|---|---|
| 4,201,132 | 5/1980 | Zimmer et al. | 101/118 |
| 5,255,598 | 10/1993 | Van Sas et al. | 101/118 |
| 5,375,516 | 12/1994 | Hasegawa | 101/116 |
| 5,979,311 | 11/1999 | Kakurai et al. | 101/118 |

FOREIGN PATENT DOCUMENTS

| | | |
|---|---|---|
| 64-18682 | 1/1989 | Japan . |
| 1-290489 | 11/1989 | Japan . |
| 3-55276 | 3/1991 | Japan . |
| 5-229243 | 9/1993 | Japan . |
| 7-17121 | 1/1995 | Japan . |
| 8-169628 | 7/1996 | Japan . |

*Primary Examiner*—Ren Yan

*Attorney, Agent, or Firm*—Oblon, Spivak, McClelland, Maier & Neustadt, P.C.

[57] ABSTRACT

A stencil printer capable of printing a multicolor image on a sheet of the present invention includes a plurality of drums arranged side by side in an intended direction of sheet transport at a preselected interval. Ink of particular color is fed to the inner periphery of each drum carrying a respective master around its outer periphery. An intermediate transport device transports a sheet from an upstream drum to a downstream drum. A controller controls the sheet conveyance speed of the intermediate transport device and/or the print conveyance speed of the downstream drum in accordance with the size and/or the position of the sheet. The printer allows a minimum of double printing and misregister to occur by making up for a delay of transport of the sheet to the downstream drum.

34 Claims, 21 Drawing Sheets

| FIG. 20A |
| --- |
| FIG. 20B |

STENCIL PRINTER

BACKGROUND OF THE INVENTION

The present invention relates to a stencil printer and, more particularly, to a stencil printer capable of producing printings with a plurality of drums.

A digital thermal printer using a stencil is extensively used for its simple configuration and easy operation. The printer includes a thermal head carrying an array of fine heating elements thereon. While the thermal head is held in contact with a thermosensitive stencil being conveyed, the heating elements are selectively energized by pulses in accordance with image data in order to perforate, or cut, the stencil by heat. After the perforated stencil, i.e., master has been wrapped around a hollow cylindrical porous drum, ink is transferred from the drum to a sheet via the perforation pattern of the master so as to print an image on the sheet. Specifically, an ink roller is disposed in the drum while a press roller is located face the ink roller in the vicinity of the drum. When the press roller is pressed against the drum, the ink is caused to ooze out from the inner periphery of the drum to the outer periphery of the same via the master. As a result, the ink is transferred from the drum to the sheet.

The above printer is capable of producing a desired number of printings, as follows. A master derived from a document of first color is wrapped around the drum, and an ink image of first color is repeatedly transferred to a desired number of sheets via the master. After a master derived from a document of second color has been wrapped around the drum, the sheets carrying images of first color are again fed from a sheet feed section to the drum one by one so as to transfer ink images of second color. This kind of procedure has the following problems left unsolved. Assume that after the transfer of ink images of first color to the desired number of sheets, but before the transfer of ink images of second color to the same sheets, the operator desires to increase the number of printings. Then, the operator must again set a desired number of sheets for the first color and repeat the printing operation all over again, resulting in time- and labor-consuming work. Moreover, because the images of second color are transferred to the sheets just after the transfer of the images of first color, the ink on the sheets deposit on and smear, e.g., the sheet feed section.

In light of the above, Japanese Patent Laid-Open Publication No. 7-17121, for example, proposes a color stencil printer including a plurality of drums arranged side by side in an intended direction of sheet transport at a preselected interval. A master derived from an image of particular color is wrapped around each of the drums. An intermediate transport device is arranged between the drums in order to transport a sheet carrying an image transferred from upstream one of the drums in the above direction to a downstream one of the drums. With this configuration, the printer is capable of effecting simultaneous multicolor printing in a single sheet feed procedure. The intermediate transport device transports a sheet at a constant speed while the drums each rotates at a constant speed synchronous with a sheet feed timing. In this condition, a sheet meets an ink image formed on each drum at a print position assigned to the drum.

However, the problem with the conventional stencil printer having the simultaneous multicolor printing capability is that ink transferred from the upstream drum to the sheet deposits on the master wrapped around the downstream drum and then deposits on the next sheet brought from the upstream drum. Let this occurrence be referred to as double printing. The amount of double printing is dependent on the print conveyance speed of the individual drum and the conveyance speed of the sheet. Further, in the case of stencil printing, the press roller presses the sheet against the associated drum in order to transfer an ink image from the drum to the sheet. As a result, the area of the ink image and therefore the amount of ink to deposit on a sheet varies in accordance with the size of the ink image and that of the sheet.

It follows that the time when the sheet adhered to the drum at the time of printing is peeled off from the drum varies in association with the amount of ink. This disturbs the position where the intermediate transport device starts conveying the sheet, and therefore the timing for feeding the sheet to the downstream drum. Consequently, the timing for transferring an ink image from the downstream drum to the sheet is deviated, resulting in the misregister between images and the previously stated double printing.

Another problem is brought about with the stencil printer including a plurality of drums when the sheet has a size or length greater than the distance between consecutive print positions respectively assigned to the upstream drum and downstream drum. Specifically, each drum is caused to rotate by a motor or similar drive source via a driveline including gears and a belt. It therefore sometimes occurs that the drums rotate at different peripheral speeds due to the deformation of belts and the production errors of gears. In this condition, it is likely that the sheet is slackened or pulled in the direction of sheet transport during printing. For example, assume that the peripheral speed of the downstream drum is higher than the peripheral speed of the upstream drum. So long as the length of the sheet is smaller than the distance between the print positions, the above difference in peripheral speed does not matter at all because the sheet is driven at the peripheral speed of the downstream drum as soon as its leading edge reaches the downstream print position and its trailing edge moves away from the upstream print position. However, if the length of the sheet is greater than the above distance, it bridges the upstream and downstream print positions and is pulled by the downstream roller in the direction of sheet transport. This is apt to dislocate the image printed on the sheet at the upstream print position or dislocates it relative to the image printed on the same sheet at the downstream print position, rendering the resulting color printing defective.

When the peripheral speed of the downstream drum is lower than the peripheral speed of the upstream drum, the sheet slackens on the intermediate transport device. The resulting color printing is also defective although the dislocation of the image printed on the sheet at the upstream print position or the dislocation thereof relative to the image printed on the same sheet at the downstream print position will be less noticeable than in the above-described case.

Technologies relating to the present invention are also taught in, e.g., Japanese Patent Laid-Open Publication Nos. 64-18682, 5-229243, 8-169628, 3-55276, and 1-290489.

SUMMARY OF THE INVENTION

It is therefore an object of the present invention to provide a stencil printer allowing a minimum of double printing and misregister to occur.

It is another object of the present invention to provide a stencil printer capable of reducing defective printing even when a plurality of drums rotate at different peripheral speeds.

In accordance with the present invention, a stencil printer includes a plurality of drums arranged side by side in the intended direction of sheet conveyance at a preselected interval, each for wrapping a respective master around its outer periphery. An ink feeding device is disposed in each drum in order to feed ink of particular color to the inner periphery of the drum. An intermediate transport device is arranged between the drums for conveying a sheet carrying an image printed by upstream one of the drums in the intended direction of sheet conveyance toward downstream one of the drums. A controller controls a timing for transferring an image from the master wrapped around the downstream drum to the sheet.

Also, in accordance with the present invention, a stencil printer includes a plurality of drums arranged side by side in the intended direction of sheet conveyance at a preselected interval, each for wrapping a respective master around its outer periphery. An ink feeding device is disposed in each drum in order to feed ink to the inner periphery of the drum. A plurality of pressing members are respectively movable into and out of contact with the drums. An intermediate transport device transports a sheet carrying an image transferred from upstream one of the drums in the intended direction of sheet conveyance at an upstream print position where the upstream drum and the respective pressing member nip the sheet toward a downstream print position where downstream one of the drums and the respective pressing member will nip the sheet. The intermediate transport device intervenes between the upstream drum and the downstream drum. A distance over which the sheet is transported from the upstream print position to the downstream print position is greater than a distance between the upstream print position and the downstream print position.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the stencil printer in accordance with the present invention will be described hereinafter.

1st Embodiment

Figure 1:
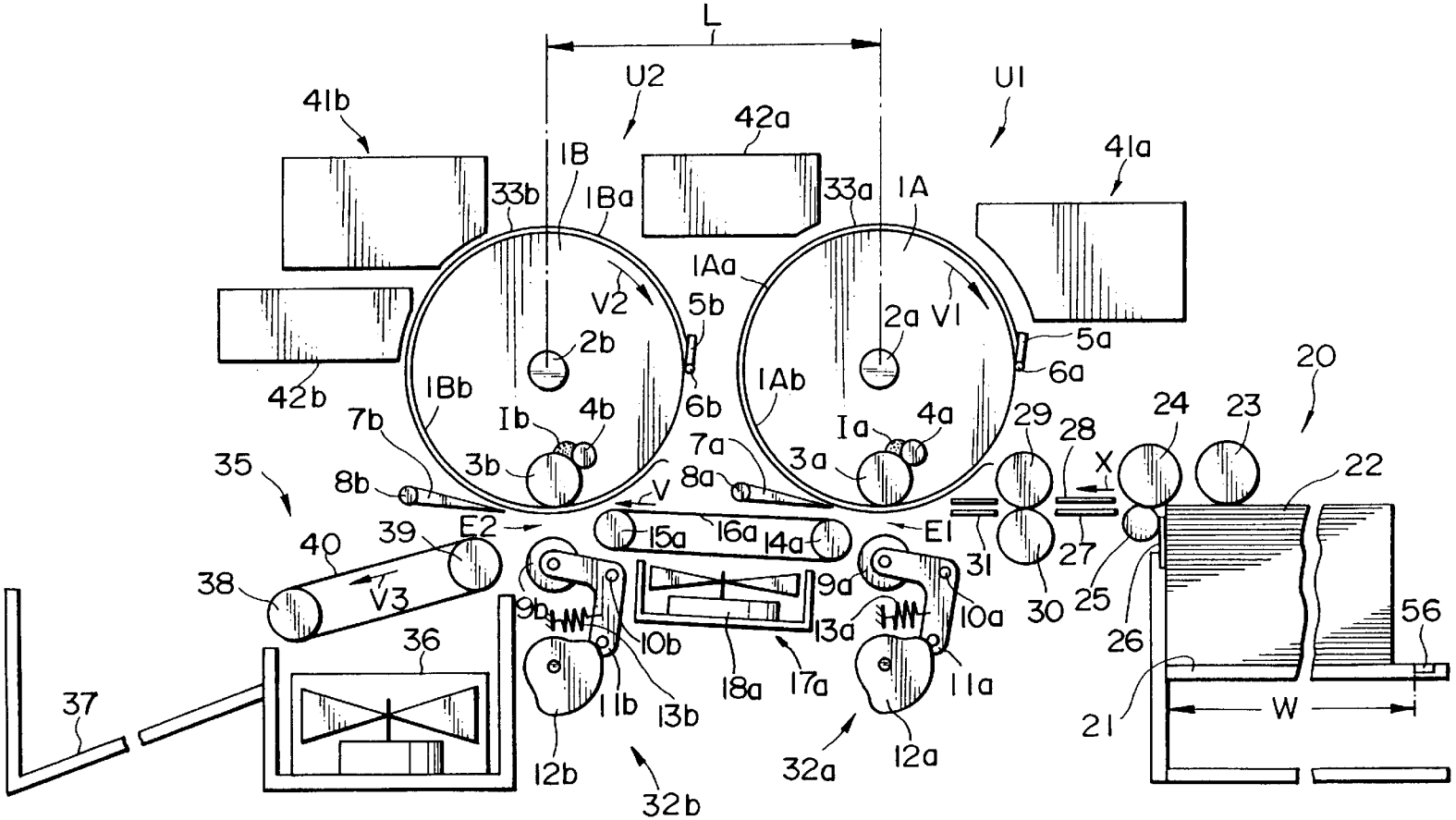
FIG. 1 shows the general construction of a first embodiment of a stencil printer in accordance with the present invention.

Referring to FIG. 1 of the drawings, a stencil printer embodying the present invention is shown and includes two drums 1A and 1B. The drums 1A and 1B are arranged side by side in an intended direction of sheet transport X, as illustrated. The drums 1A and 1B will sometimes be referred to as an upstream drum 1A and a downstream drum 1B, respectively. With the drums 1A and 1B, the stencil printer is capable of effecting simultaneous multicolor (two-color in the embodiment) printing. The drums 1A and 1B are substantially identical in configuration and function. Likewise, ink feeding means, a master making device, a master discharging device and other constituents arranged around the drum 1A and those arranged around the drum 1B are substantially identical in configuration and function and therefore distinguished from each other by suffixes a and b added to identical reference numerals. When either one of the means and devices assigned to the two drums 1A and 1B is described in detail, the other will not be described as far as possible in order to avoid redundancy.

The above double drum type stencil printer is similar in structure to a conventional thermal printer having a digital master making function. Specifically, as shown in FIG. 1, the upstream drum 1A has an outer periphery 1A*a* for wrapping a master 33*a* therearound. A master making device 41*a* is positioned above and at the right of the drum 1A in order to make the master 33*a*. A sheet feeding device 20 is positioned below the master making device 41*a* and includes a sheet tray 21 loaded with a stack of sheets 22. A master discharging device 42*a* is located above and at the left of the drum 1A in order to remove the master 33*a* from the drum 1A after the master 33*a* has been used. A pressing device 32*a* is arranged below the drum 1A in order to press the sheet 22 being transported against the master 33*a* wrapped around the drum 1A. An air knife 7*a* peels the sheet 22 coming out of a print position E1 between the drum 1A and the pressing device 32*a* off the drum 1A. The upstream drum 1A, master making device 41*a*, master discharging device 42*a*, pressing device 32*a* and air knife 7*a* constitute a first unit U1.

The downstream drum 1B has an outer periphery 1B*a* for wrapping the master 33*b* therearound. A master making device 41*b* is positioned above and at the left of the drum 1B in order to make a master 33*b*. A master discharging device

42*b* is located at the left of the drum 1B in order to remove the master 33*b* from the drum 1B after the master 33*b* has been used. A pressing device 32*b* is arranged below the drum 1B in order to press the sheet 22 being transported against the master 33*b* wrapped around the drum 1B. An air knife 7*b* peels the sheet or printing 22 coming out of a print position E2 between the drum 1B and the pressing device 32*b* off the drum 1B. The downstream drum 1B, master making device 41*b*, master discharging device 42*b*, pressing device 32*b* and air knife 7*b* constitute a second unit U2.

An intermediate transport device 17*a* transports the sheet 22 carrying an image formed at the print position E1 toward the print position E2. A sheet discharging device 35 is arranged below the master discharging device 42*b* in order to discharge the sheet or multicolor printing coming out of the print position E2 to a printing tray 37. An image reading device, not shown, for reading a document image is located above the master making devices 41*a* and 41*b* and master discharging device 42*a*. An operation panel 70 (see FIG. 3) is also located above the master making devices 41*a* and 41*b* and master discharging device 42*a*.

The operation of the above stencil printer will be described hereinafter together with the details of the individual device. The drum 1A is rotatably mounted on a shaft 2*a* and implemented as a conventional hollow porous cylinder. The drum 1A is rotated in a direction indicated by an arrow in FIG. 1 by a drum motor which will be described later. A damper 5*a* for clamping the leading edge of the master 33*a* is openably mounted on the surface 1A*a* of the drum 1A and extends along a line parallel to the axis of the drum 1A. Specifically, the damper 5*a* is angularly movably mounted on the drum 1A via a shaft 6*a* and opened and closed at a preselected position by opening/closing means, not shown. The opening/closing means is located at a suitable position around the drum 1A. Ink feeding means is arranged within the drum 1A in order to feed ink from an inner periphery 1A*b* to the outer periphery 1A*a* of the drum 1A. In the illustrative embodiment, the ink feeding means assigned to the drum 1A is assumed to feed magenta ink as ink of first color. Likewise, ink feeding means assigned to the drum 1B is assumed to feed black ink as ink of second color.

The master 33*a* consists of a porous substrate formed of, e.g., Japanese paper and a film adhered to the substrate and formed of polyester or similar thermoplastic resin. Alternatively, the master 33*a* may be implemented only by an extremely thin thermoplastic resin film.

Assume that the operator sets a desired document on a tray, not shown, included in the image reading device and then presses a perforation start key 73 (see FIG. 3) for starting a master making operation. Then, a master discharging step is executed with each of the drums 1A and 1B in the same manner. Specifically, the drum 1A is rotated counterclockwise, i.e., in the direction opposite to the direction indicated by an arrow. As a result, the used master 33*a* is sequentially peeled off from the drum 1A and conveyed toward a waste master box, not shown.

In parallel with the above master discharging step, the image reading section is operated to read the document set on the tray, using a conventional reduction type scanning scheme. The image read out of the document is transformed to an electric signal by a CCD (Charge Coupled Device) image sensor or similar photoelectric transducer not shown. The electric signal is fed to an analog-to-digital converter (ADC), not shown, and converted to a digital image signal thereby.

In the image reading device, an arrangement for color separation essential for multicolor printing is provided on an optical path between a group of mirrors and a lens, although not shown specifically. The above arrangement may be implemented by a filter unit taught in, e.g., Japanese Patent Laid-Open Publication No. 64-18682 mentioned earlier and capable of selecting one of a plurality of filters at a time. With this arrangement, the printer is capable of automatically making a master and feeding it in the same manner as described in the above document.

In parallel with the image reading operation, the master making devices 41*a* and 41*b* each makes a respective master in accordance with the digital image signal. Specifically, in the master making device 41*a*, a platen roller, not shown, is pressed against a flat thermal head, not shown, and rotated together with a feed roller pair, not shown, conveying the master 33*a* to the downstream side of a master transport path. At this instant, an array of heating elements arranged on the thermal head in the main scanning direction selectively generate heat in accordance with the digital image signal subjected to various kinds of processing at a master making control board, not shown, following the ADC. As a result, the thermoplastic resin film of the master 33*a* is selectively melted and perforated by the heating elements generating heat. In this manner, image information are written in the master 33*a* in the form of a perforation pattern.

The feed roller pair drives the leading edge of the perforated master 33*a* toward the outer periphery 1A*a* of the upstream drum 1A. A guide, not shown, steers the master 33*a* such that the master 33*a* hangs down toward the damper 5*a* of the drum 1A which is open at its clamping position, as illustrated. The used master 33*a* has already been removed from the drum 1A by the master discharging step stated previously. On the other hand, a feed roller pair included in the master making device 41*b* drives the leading edge of the perforated master 33*b* toward the outer periphery 1B*a* of the downstream drum 1B while a guide, not shown, guides the master 33*b* in substantially the horizontal direction. The master 33*b* is inserted into the damper 5*b* which is open at its clamping position. The clamping position of the damper 5*b* is defined substantially at the top of the drum 1B, as viewed in FIG. 1.

After the damper 5*a* has clamped the leading edge of the master 33*a* at a preselected timing, the drum 1A is rotated clockwise, as viewed in FIG. 1, so as to sequentially wrap the master 33*a* therearound. The trailing edge of the master 33*a* is cut off at a preselected length by cutting means (not shown) disposed in the master making device 41*a* and made up of, e.g., a movable edge and a stationary edge. The master feeding step ends when the master 33*a* is fully wrapped around the drum 1A.

After the masters 33*a* and 33*b* have been respectively wrapped around the drums 1A and 1B, a trial printing step and a printing step are sequentially executed, as follows. The sheet tray 21 is raised to a position where the top sheet 22 contacts a pick-up roller 23 beforehand. The pick-up roller 23 in rotation pays out the top sheet 22 while a pair of separation rollers 24 and 25 and a separation plate 26 cooperate to separate the top sheet 22 from the underlying sheets 22. The top sheet 22 is conveyed toward a pair of registration rollers 29 and 30 in the sheet transport X while being guided by an upper and a lower guide plate 28 and 27, respectively. The sheet 22 is brought to a stop with its leading edge abutting against a portion just short of a nip between the registration rollers 29 and 30. At this instant, the sheet 22 is slackened on and along the upper guide plate 28.

On the start of a printing operation, the upstream drum 1A is caused to rotate at a speed V1 which is a conveying speed for printing (print conveyance speed hereinafter). In the drum 1A, magenta drum fed from an ink distributor, not shown, is fed to an ink well Ia formed between an ink roller 3*a* and a doctor roller 4*a*. The magenta ink deposits on the periphery of the ink roller 3*a* uniformly while being kneaded and spread by the ink roller 3*a* and doctor roller 4*a* in rotation. The amount of residual ink is sensed by ink sensing means, e.g., one taught in Japanese Patent Laid-Open Publication No. 5-229243 (FIG. 2) mentioned earlier. When the residual ink is short, the ink distributor replenishes it. The ink roller 3*a* rolls on the inner periphery 1A*b* of the drum 1A while rotating in the same direction as and at the same speed as the drum 1A, thereby feeding the ink to the inner periphery of the drum 1A.

The pressing device 32*a* is implemented by the above ink roller 3*a* and a press roller 9*a*, a bracket 11*a*, a tension spring 13*a* and a sectorial cam 12*a*, as follows. The press roller or pressing means 9*a* presses the sheet 22 against the drum 1A, so that an image is formed on the sheet 22. The press roller 9*a* is rotatably supported by one end of the bracket 11*a* and movable into and out of contact with the drum 1A. The press roller 9*a* is pressed against the drum 1A by the tension spring 13*a* anchored to the other end of the bracket 11*a*. At the same time, the tension spring 13*a* presses the associated end of the press roller bracket 11*a* against the profile of the cam 12*a*. The cam 12*a* is rotated by the drum motor, which will be described, in synchronism with the feed of the sheet 22 form the sheet feeding device 20 and the rotation of the drum 1A. When the sheet 22 is not fed from the sheet feeding device 20, a larger diameter portion included in the cam 12*a* remains in contact with the end of the bracket 11*a*. When the sheet 22 is fed from the sheet feeding device 20, the cam 12*a* is rotated until a smaller diameter portion thereof contacts the end of the bracket 11*a*, causing the press roller 9*a* to rotate clockwise, as viewed in FIG. 1.

The sheet 22 is fed to the print position E1 between the drum 1A and the press roller 9*a* by the registration rollers 29 and 30 at a preselected timing synchronous with the rotation of the drum 1A. Then, the press roller 9*a* is moved angularly upward so as to press the sheet 22 against the master 33*a* wrapped around the drum 1A. As a result, the master 33*a* is closely adhered to the outer periphery 1A*a* of the drum 1A due to the viscosity of the ink oozed out via the porous portion of the drum 1A. At the same time, the ink oozes out via the perforation pattern of the master 33*a* and is transferred to the surface of the sheet 22, forming an image of first color on the sheet 22.

When the leading edge of the sheet 22 with the image of first color approaches the air knife 7*a*, the air knife 7*a* is rotated about its shaft 8*a* toward the drum 1A in synchronism with the rotation of the drum 1A. Then, air under pressure fed from a pneumatic pressure source is blown out from the edge of the air knife 7*a*. consequently, the leading edge of the sheet 22 is peeled off from the drum 1A and further conveyed to the downstream side in the direction X by the intermediate transport device 17*a*.

The intermediate transport device 17*a* is made up of a drive roller 15*a*, a driven roller 14*a*, a porous belt 16*a* passed over the rollers 15*a* and 14*a*, and a suction fan 18*a*. Control means 34 (see FIG. 2) causes the belt 16*a* to transport the sheet 22 at a controllable speed. The sheet 22 separated from the drum 1A by the air knife 7*a* is transported by the belt 16*a* toward the next print position E2 while being retained on the belt 16*a* by the suction fan 18*a*.

The downstream drum 1B is caused to start rotating clockwise, i.e., in the direction indicated by an arrow at a speed V2 in synchronism with the rotation of the drum 1A. An ink roller 3*b* is disposed in the drum 1B and held in contact with an inner periphery 1B*b* of the drum 1B. The ink roller 3*b* feeds black ink to the inner periphery of the drum 1B while rotating in synchronism with the drum 1B in exactly the same manner as the ink roller 3*a*.

The sheet 22 is brought to the print position E2 between the drum 1B and a press roller 9*b* by the belt 16*a* at a preselected timing. Then, the press roller 9*b* is moved angularly upward so as to press the sheet 22 against the master 33*b* wrapped around the drum 1B. As a result, the master 33*b* is closely adhered to the outer periphery 1B*a* of the drum 1B due to the viscosity of the ink oozed out via the porous portion of the drum 1B. At the same time, the ink oozes out via the perforation pattern of the master 33*b* and is transferred to the surface of the sheet 22 over the image of first color.

When the leading edge of the sheet 22 with the composite image of first and second colors approaches the air knife 7*b*, the air knife 7*b* is rotated about its shaft 8*b* toward the drum 1B in synchronism with the rotation of the drum 1B. Then, air under pressure fed from the pneumatic pressure source is blown out from the edge of the air knife 7*b*. Consequently, the leading edge of the sheet 22 is peeled off from the drum 1B and further conveyed to the downstream side in the direction X by the sheet discharging device 35 until it reaches the printing tray 37.

The sheet discharging device 35 includes a drive roller 38, a driven roller 39, a porous belt 40 passed over the rollers 38 and 39, and a suction fan 36. The belt 40 is driven in synchronism with the drum 1A at a speed V3 substantially equal to the rotation speed V1 of the drum 1A. While the belt 40 is in counterclockwise rotation, the sheet 22 is transported to the printing tray 37 by the belt 40 as a trial printing while being retained on the belt 40 by the suction fan 36. This is the end of the trial printing step.

Figure 3:
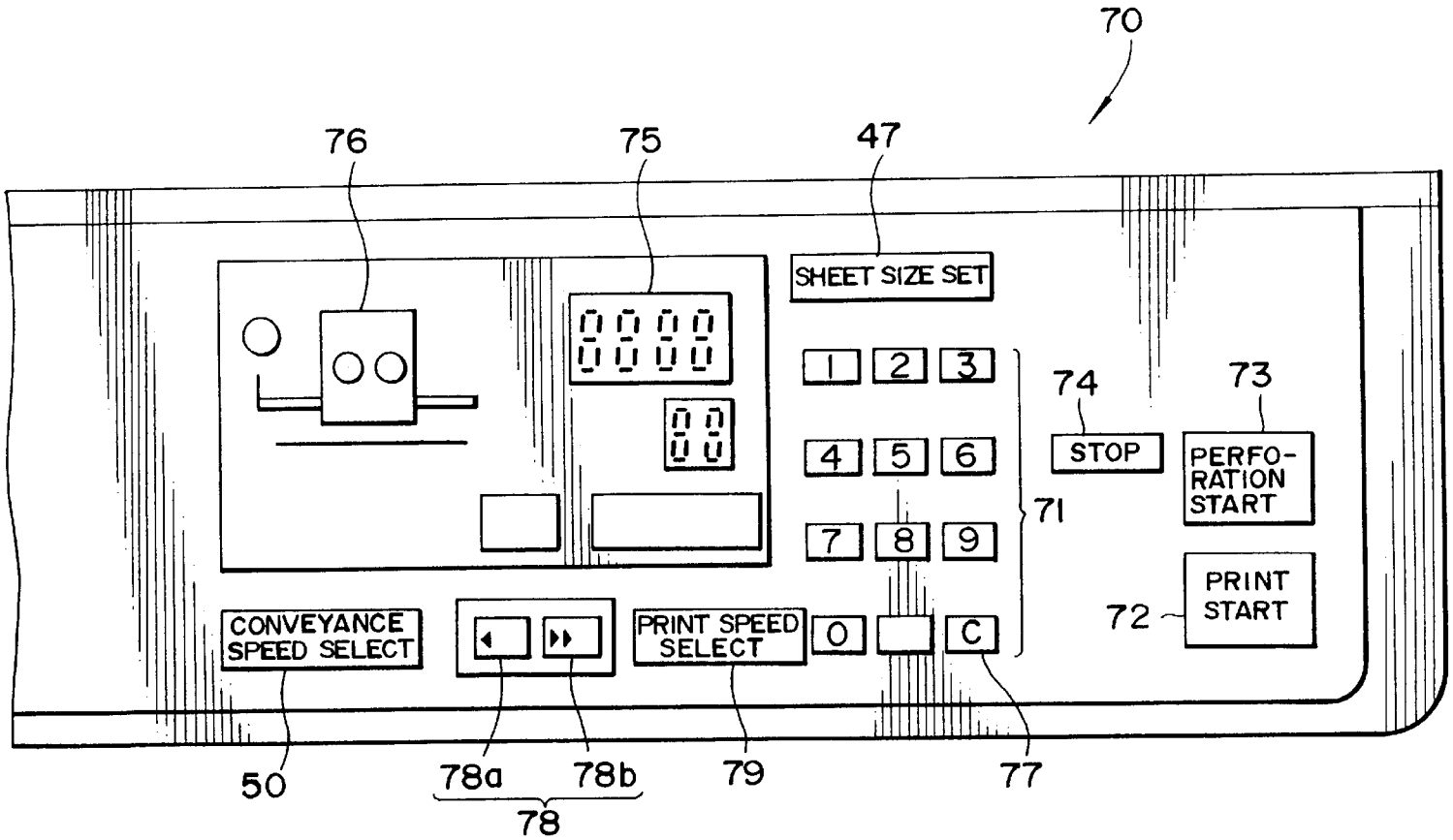
FIG. 3 is a fragmentary plan view of an operation panel included in the first embodiment.

If the image printed on the sheet or trial printing 22 is acceptable, the operator sets a desired number of printings on numeral keys 71 arranged on the operation panel 70, FIG. 3, and then presses a print start key 72. In response, the sheet feeding step, printing step and sheet discharging step are repeated in exactly the same manner until a desired number of printings have been produced. This is the end of the entire printing operation.

It is to be noted that the specific configurations and locations of the above various devices are only illustrative and may, of course, be replaced with any other configurations and locations. For example, the air knives 7*a* and 7*b* may be replaced with conventional peelers respectively adjoining the drums 1A and 1B and angularly rotatable about their shafts.

The illustrative embodiment is practicable even with a stencil printer in which the drums 1A and 1B are implemented as drum units removably mounted to the printer, as distinguished from the above printer having a master making function. In such a stencil printer, masters may be made by a master feeding device constructed independently of the printer body and removed from the drums 1A and 1B by a master discharging device also constructed independently of the printer body. That is, the printer body does not have to be provided with the master making devices 41*a* and 41*b* or the master discharging devices 42*a* and 42*b* thereinside. Also, data output from, e.g., a computer may be used to make masters in place of the data output from the document reading device. In the illustrative embodiment, the leading edge of an image refers to the leading edge of an image area formed in a master which, in turn, refers to the leading edge of a document scanned first.

The illustrative embodiment is characterized in that a peripheral speed V of the belt 16*a* defining a sheet conveyance speed is variable in accordance with the size of the sheet 22. This allows the timing for feeding the sheet 22 to the print position E2 to be controlled.

Figure 2:
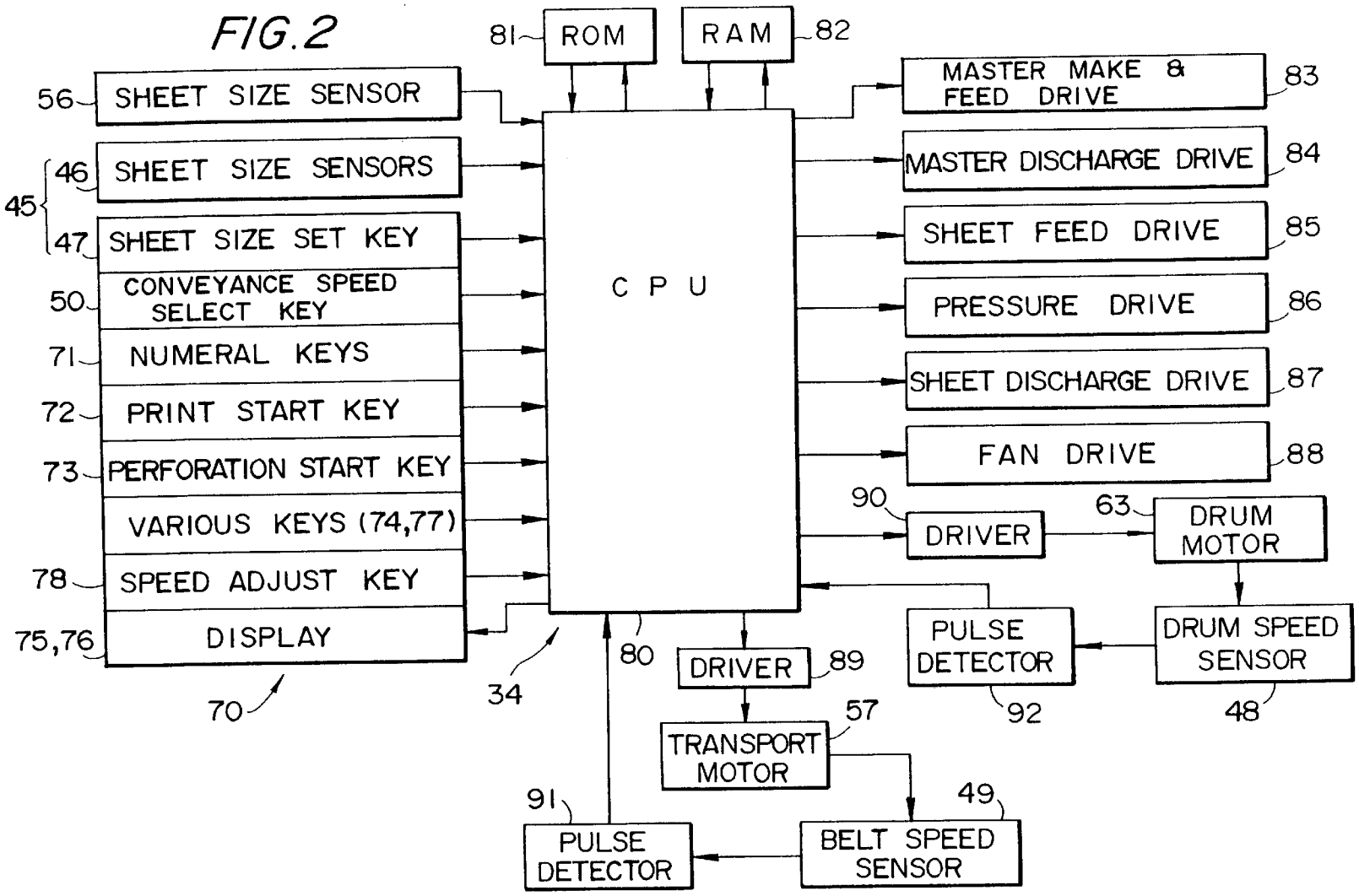
FIG. 2 is a block diagram schematically showing control means included in the first embodiment.

Specifically, as shown in FIG. 2, the embodiment includes, in addition to the control means 34, sheet size recognizing means 45, a drum speed sensor or drum speed sensing means 48, a belt speed sensor or conveyance speed sensing means 49, and a conveyance speed select key 50 and a speed adjust key 78 constituting sheet conveyance speed selecting means in combination. The sheet size recognizing means 45 constitutes a group of sheet size sensors or sheet size sensing means 46 and a sheet size set key or sheet size setting means 47. The drum speed sensor 48 is responsive to the rotation speed or print conveyance speed V1 of the drum 1A. The belt speed sensor 49 is responsive to the peripheral speed or conveyance speed V of the belt 16*a*. The keys 50 and 78 allow the operator to manually select a desired peripheral speed V of the belt 16*a*.

Figure 4:
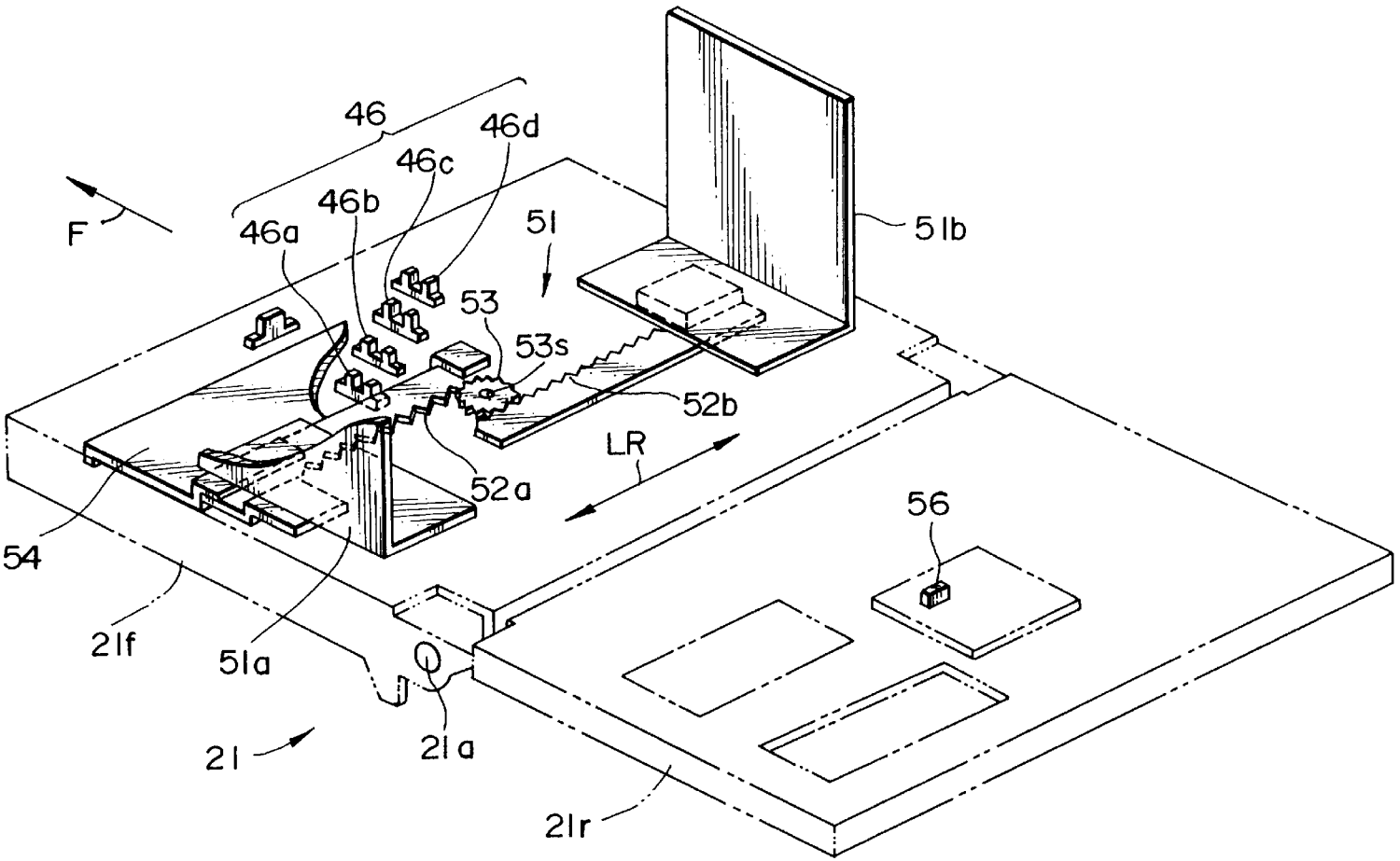
FIGS. 4 and 5 are fragmentary perspective views showing sheet size sensors included in the first embodiment and members associated therewith.
Figure 5:
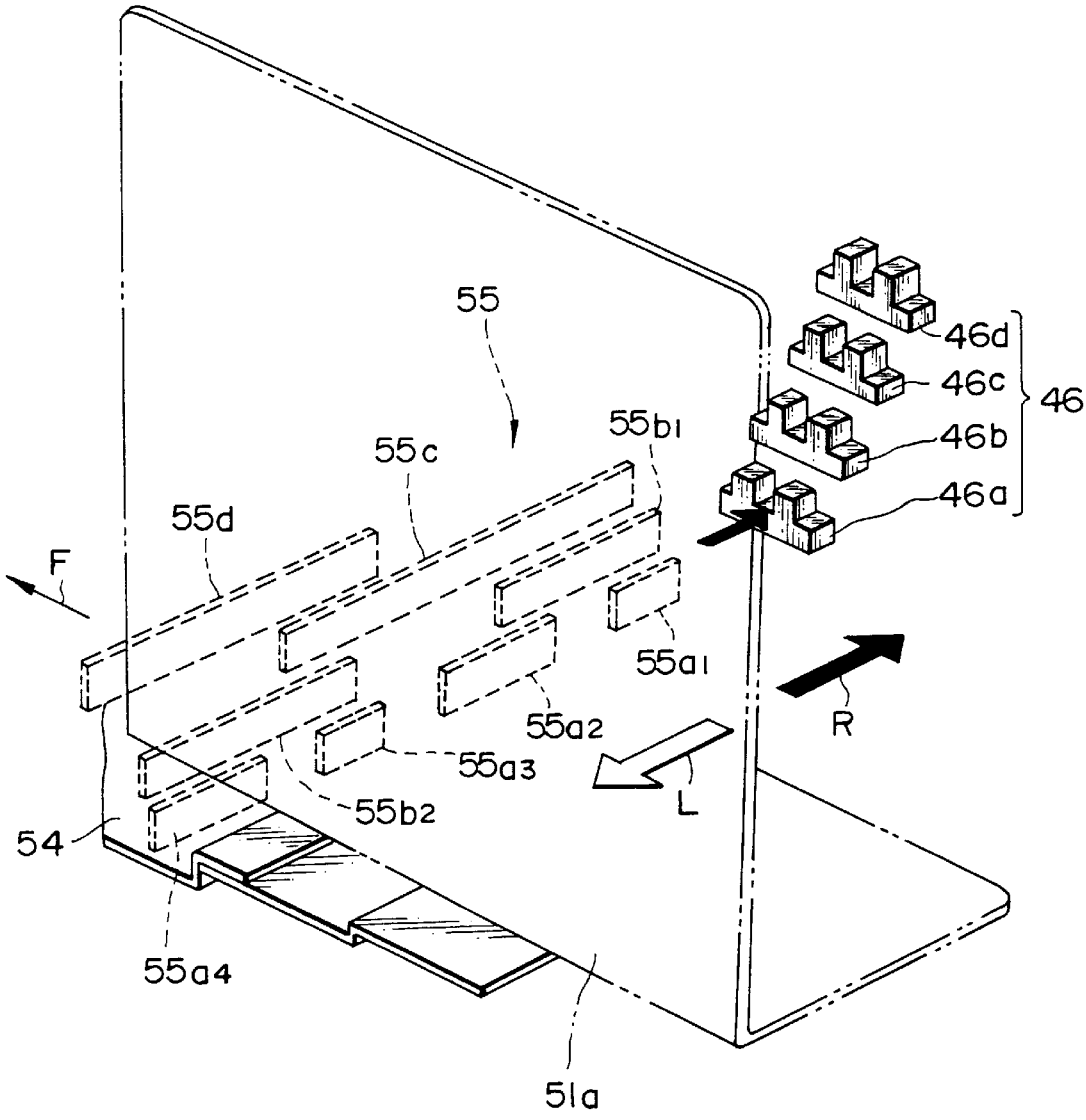
Figure 6:
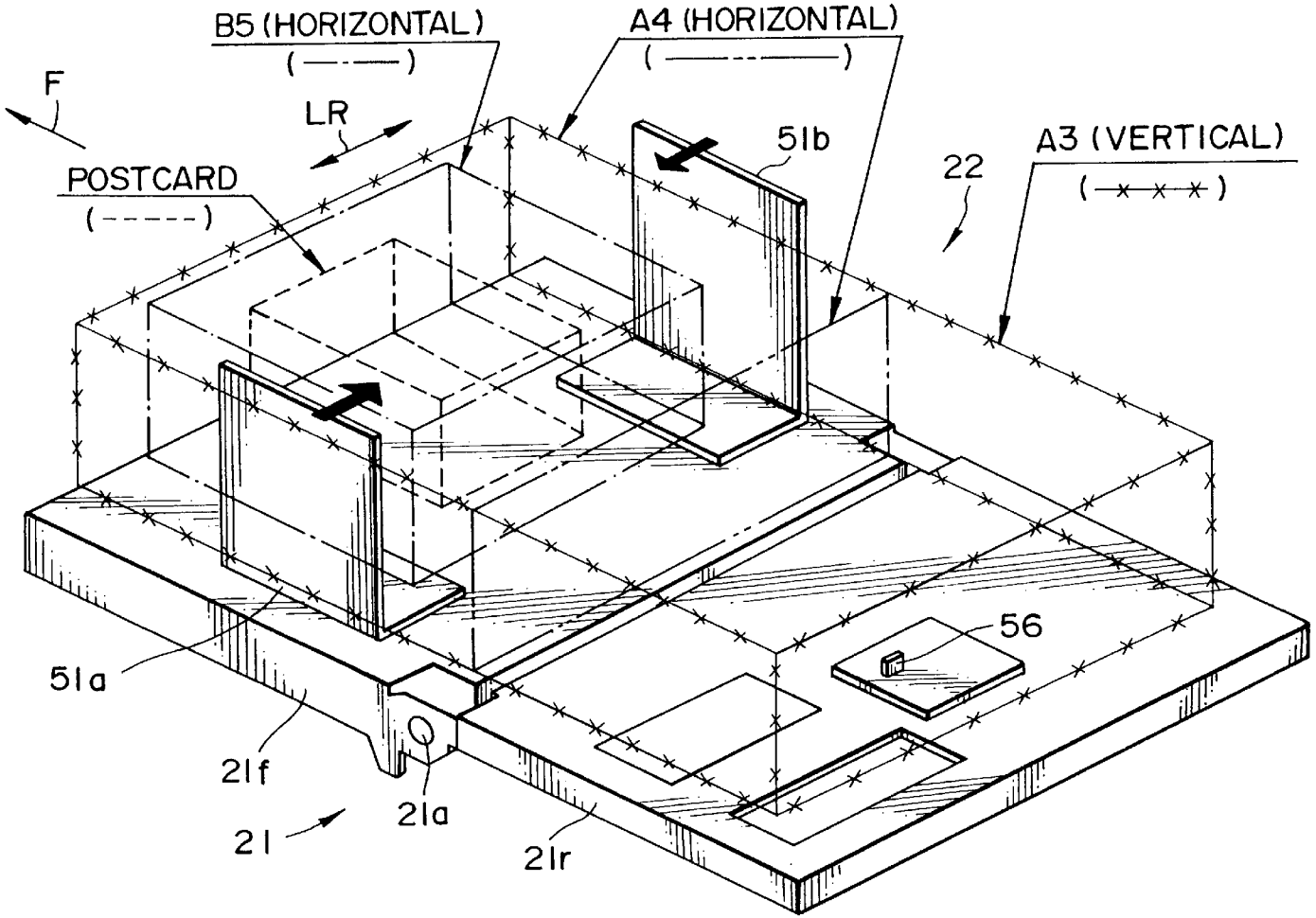
FIG. 6 is a perspective view showing sheets and their sizes applicable to a sheet tray included in the first embodiment.

As shown in FIGS. 4 to 6, the sheet size sensor group 46 is arranged on the sheet tray 21. The sheet tray 21 is made up of a former half 21*f* and a latter half 21*r* hinged to each other by a shaft 21*a*. A side guide mechanism 51 is provided on the sheet tray 21 and includes side fences 51*a* and 51*b* facing each other. Rack gears 52*a* and 52*b* are respectively affixed to a part of the rear of the side fence 51*a* and a part of the rear of the side fence 51*b*. The rack gears 52*a* and 52*b* each is formed with gear teeth at its one edge and slidable in the widthwise direction of the sheet 22 labeled LR. A pinion 53 is interposed between the rack gears 52*a* and 52*b* and held in mesh with the gear teeth of the rack gears 52*a* and 52*b*. The pinion 53 is rotatably mounted on a pinion shaft 53*s* affixed to the rear of the former half 21*f* of the sheet tray 21. The former half 21*f* of the sheet tray 21 is sandwiched between the rack gears 52*a* and 52*b* and the bottoms of the side fences 51*a* and 51*b*.

A group of interrupters 55 are affixed to an interruption plate 54 which is provided at the other edge of the rack gear 52*a*. The interrupters 55 are arranged at predetermined intervals in the widthwise direction LR of the sheet 22, and each has a particular length. Further, the interrupters 55 are spaced from each other in an intended direction of sheet feed F. Specifically, the interrupters 55 are implemented as an array of interrupters $\mathbf{55}a_1$, $\mathbf{55}a_2$, $\mathbf{55}a_3$ and $\mathbf{55}a_4$, and an array of interrupters $\mathbf{55}b_1$ and $\mathbf{55}b_2$, an interrupter 55*c* and an interrupter 55*d* each cooperating with a particular sheet size sensor which will be described hereinafter.

The sheet size sensors 46 are affixed to the rear of the former half 21*f* of the sheet tray 21. Specifically, four sheet size sensors 46*a*, 46*b*, 46*c* and 46*d* are arranged at preselected intervals in the direction LR and direction F, as illustrated. The sheet size sensors 46*a*–46*d* each is implemented as a conventional photointerrupter type sensor having a light emitting element and a light-sensitive element. The sheet size sensors 46*a*–46*d* are selectively interrupted by the interrupters $\mathbf{55}a_1$–55*d* in order to sense relatively small sheet sizes.

Another sheet size sensor or sheet size sensing means 56 is mounted on the rear of the latter half 21*r* of the sheet tray 21 in order to sense the size of the sheets 22 stacked on the tray 21. The sheet size sensor 56 is implemented as a reflection type sensor having a light emitting element and a light-sensitive element. When the sheets 22 are present on the tray 21, the sensor 56 turns on in response to a reflection from the sheets 22 and shows that the sheets 22 are present on the rear half 21*r*. The sensor 56 is used in combination with the sensors 46 in order to sense relatively large sheet sizes. The sensors 46 and 56 are electrically connected to the control means 34.

The operator moves the side fences 51*a* and 51*b* in matching relation to the size of the sheets 22. As a result, postcards or sheets of size B5 and oriented horizontally long, or of size A4 and oriented horizontally long or of size A3 oriented vertically long are positioned on the sheet tray 21, as shown in FIG. 6 specifically. Further, the interruption plate 54 is slid in interlocked relation to the side fences 51*a* and 51*b*. Consequently, there are determined a relation between the sheet size sensor 46*a* and the interrupters $\mathbf{55}a_1$–$\mathbf{55}a_4$, a relation between the sheet size sensor 46*b* and the interrupters $\mathbf{55}b_1$ and $\mathbf{55}b_2$, a relation between the sheet size sensor 46*c* and the interrupter 55*c*, and a relation between the sheet size sensor 46*d* and the interrupter 55*d*. Table 1 shown below lists the lengths of the sheets 22 in the widthwise direction LR (widthwise sizes) determined on the basis of the combinations of ON/OFF signals output from the sheet size sensors 46*a*–46*d*. However, the positions of the side fences 51*a* and 51*b* indicate only the widthwise size of the sheets 22; for example, sheets of size A4 oriented horizontally long and sheets of size A3 oriented vertically long have the same widthwise size and cannot be distinguished from each other as to orientation. In light of this, the sheet size sensor 56 is used in combination with the sheet size sensors 46*a*–46*d*. Assuming the above specific case, the sheets 22 are determined to be of size A3 oriented vertically long (direction F) if the sensor 56 is turned on, or of size A4 oriented horizontally long if the sensor 56 is turned off. The control means 34 can therefore determine the size of the sheets 22 on the basis of the combination of the outputs of the sensors 46*a*–46*d* and 56.

TABLE 1

| Sheet Size Sensor | | | | | | |
|---|---|---|---|---|---|---|
| 46a | 46b | 46c | 46d | 56 | Sheet Size | |
| — | — | — | — | — | * | 318 × 210 (mm) |
| ○ | — | — | — | — | A4 horizontal | 297 × 210 |
| ○ | ○ | — | — | — | * | 288 × 210 |
| — | ○ | — | — | — | LT horizontal | 280 × 216 |
| — | ○ | ○ | — | — | * | 268 × 216 |
| ○ | ○ | ○ | — | — | B5 horizontal | 257 × 182 |
| ○ | — | ○ | — | — | * | 236 × 182 |
| — | — | ○ | — | — | A4 verticai | 210 × 297 |
| — | — | ○ | ○ | — | LT vertical | 216 × 280 |
| ○ | — | ○ | ○ | — | * | 196 × 297 |
| ○ | ○ | ○ | ○ | — | B5 vertical | 182 × 257 |
| — | ○ | ○ | ○ | — | * | 166 × 257 |
| — | ○ | — | ○ | — | A5 vertical | 148 × 210 |
| ○ | ○ | — | ○ | — | * | 124 × 210 |
| ○ | — | — | ○ | — | postcard | 100 × 148 |
| — | — | — | ○ | — | * | 90 × 148 |
| — | — | — | — | ○ | * | 318 × 420 |
| ○ | — | — | — | ○ | A3 vertical | 297 × 420 |
| ○ | ○ | — | — | ○ | * | 288 × 420 |
| — | ○ | — | — | ○ | DLT vertical | 280 × 432 |
| — | ○ | ○ | — | ○ | * | 268 × 432 |
| ○ | ○ | ○ | — | ○ | B4 vertical | 257 × 364 |
| ○ | — | ○ | — | ○ | * | 236 × 364 |
| — | — | ○ | — | ○ | LG vertical | 216 × 356 |
| — | — | ○ | ○ | ○ | * | 210 × 297 |
| ○ | — | ○ | ○ | ○ | * | 196 × 297 |
| ○ | ○ | ○ | ○ | ○ | * | 182 × 257 |
| — | ○ | ○ | ○ | ○ | * | 166 × 257 |
| — | ○ | — | ○ | ○ | HLT | 148 × 210 |

TABLE 1-continued

| Sheet Size Sensor | | | | | | |
|---|---|---|---|---|---|---|
| 46a | 46b | 46c | 46d | 56 | | Sheet Size |
| ○ | ○ | — | ○ | ○ | * | 124 × 210 |
| ○ | — | — | ○ | ○ | * | 100 × 148 |
| — | — | — | ○ | ○ | * | 90 × 148 |

In Table 1, the ON states of the outputs of the sensors 46*a*–46*d* and 56 are represented by circles while the OFF states of the same are represented by dashes. Asterisks each indicate a particular irregular size or medium size between regular sizes. LT, DLT, LG and HLT respectively standing for a letter size, a double letter size, a legal size, and a half letter size. Table 1 indicates that each combination of the ON/OFF states of the sensors 46*a*–46*d* and 56 causes a corresponding particular sheet size to be identified.

The sensor 56 is used to simply determine whether or not the sheets 22 are present in the sheet feed direction F, i.e., it does not have to sense the sheets 22 continuously. Therefore, one or two sensors 56 suffice, as in the illustrative embodiment. The sensor 56 may be replaced with a conventional photointerrupter having a feeler in addition to a light emitting element and a light-sensitive element. Even when, e.g., a single transparent sheet is present on the sheet tray 21 in order to print an image thereon, the feeler of the photointerrupter will move and cause a sectorial interrupter to interrupt light. Further, use may be made of a microswitch or similar sensing means needing a minimum of actuating force.

As shown in FIG. 1, assume that the sensor 56 mounted on the sheet tray 21 is spaced from the leading edge of the sheet stack 22 by a preselected distance slightly greater than a sheet conveyance distance W. Then, it is possible to determine whether or not the sheet stack 22 has a length greater than the distance W in the sheet feed direction F. Particularly, when the length of the sheet stack 22 is greater than the distance W, it is possible to maintain the pick-up roller 23 inoperative in order to obviate a defective trial printing. If desired, the registration rollers 29 and 30 may be maintained inoperative in place of the pick-up roller 23.

The sheet size set key 47 is provided on the operation panel 70 and allows the operator to manually select the size of the sheets 22.

Figure 7:
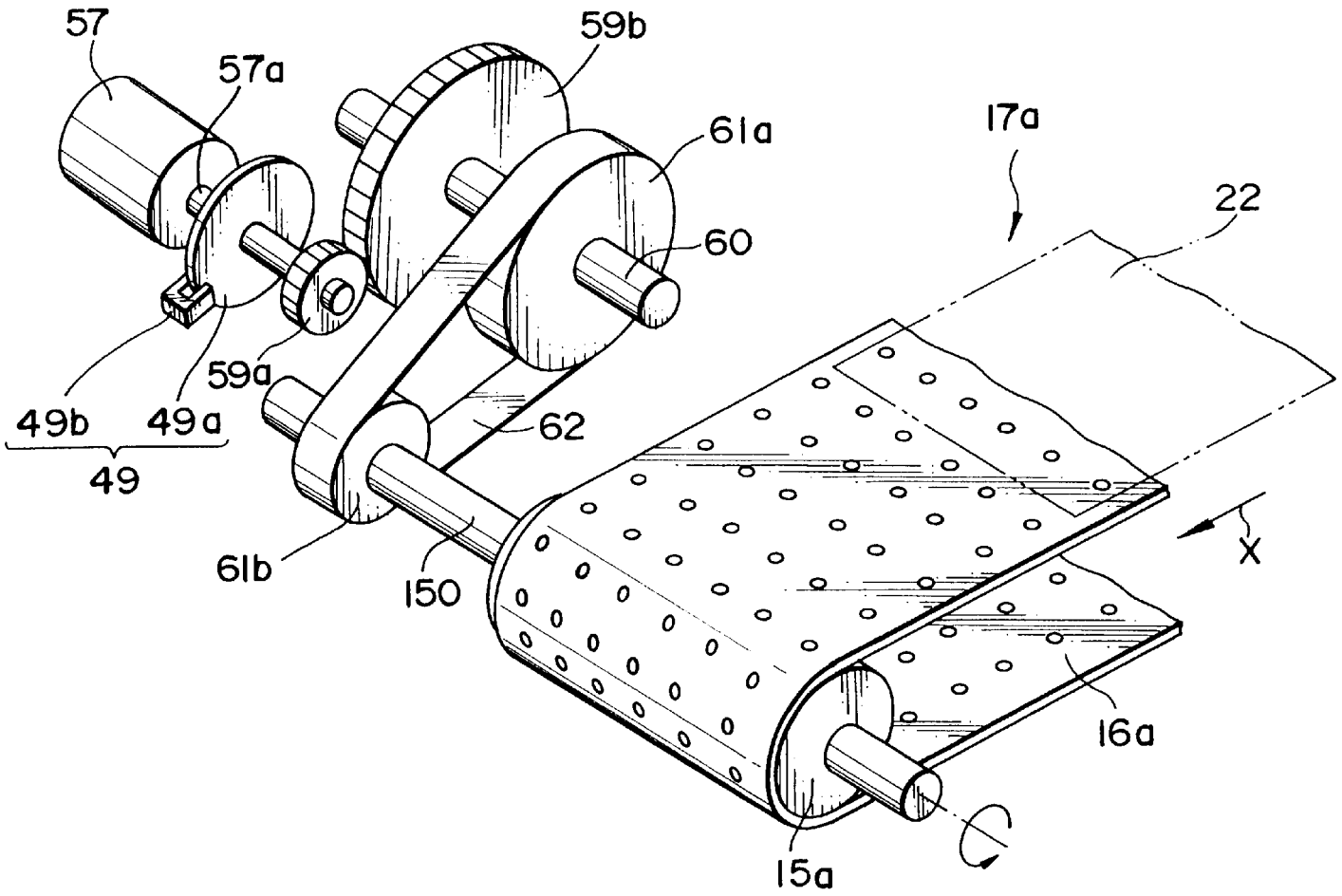
FIG. 7 is an enlarged perspective view showing conveyance speed sensing means and an intermediate transport device included in the first embodiment.

As shown in FIG. 7, the belt speed sensor 49 is implemented as a rotary encoder made up of a slit disk 49*a* and a photointerrupter 49*b*. The disk 49*a* is affixed to an output shaft 57*a* of a transport motor 57 which drives the belt 16*a* via the drive roller 15*a*. The photointerrupter 49*b* has a light source and a light-sensitive element positioned at both sides of the disk 49*a*. If desired, the belt speed sensor 49 may be replaced with any other suitable conveyance speed sensing means, e.g., a magnetic encoder.

A drive gear 59*a* is mounted on the output shaft 57*a* of the transport motor 57 and held in mesh with a gear 59*b* having a large diameter and affixed to a support shaft 60. An endless belt 62 is passed over a pulley 61*a* mounted on the support shaft 60 and a pulley 61*b* mounted on a shaft 150 of the drive roller 15*a*. The output torque of the motor 57 is transmitted to the shaft 150 by the above driveline. The motor 57 is implemented by a stepping motor. The rotation speed of the motor 57 is varied on the basis of frequency by a control signal output from the control means 34 or a select signal output from the speed select key 50. As a result, the peripheral speed V of the belt 16*a* is varied. In the illustrative embodiment, the peripheral speed V of the belt 16*a* is selected to be about 1.2 times as high as the peripheral speed V1 of the upstream drum 1A.

The drum speed sensor 48 is a conventional rotary encoder mounted on an output shaft of a drum motor 63 shown in FIG. 2. The drum speed sensor 48 sends its output representative of the rotation speed V1 of the drum 1A to the control means 34. The motor 63 is drivably connected to the drums 1A and 1B by drive transmitting means, not shown, and causes them to rotate at the same speed. The control means 34 causes the drum motor 63 to rotate in synchronism with the registration timing of the registration rollers 29 and 30.

As shown in FIG. 3, the previously mentioned numeral keys 71, print start key 72, sheet size set key 47, conveyance speed select key 50 and speed adjust key 78 are arranged on the operation panel 70. The sheet size set key 47 allows the operator to set a sheet size including the orientation of the sheets 22. The speed select key 50 allows the operator to select a desired peripheral speed V of the belt 16*a* by interrupting a program which will be described. The speed adjust key 78 is implemented as a down key 78*a* and an up key 78*b* selectively operated to vary the rotation speed of the transport motor 57 or drum motor 63 stepwise. Also arranged on the operation panel 70 are a stop key 74, a display 75 implemented by LEDs (Light Emitting Diodes), a monitor display 76, a clear key 77, and a print speed select key 79. The stop key 74 is used to interrupt the procedure ending with the printing step. The display 75 displays a sheet size selected on the sheet size set key 47, a desired number of printings input on the numeral keys 71, and other necessary information. The monitor display 76 displays the locations and contents of errors relating to the masters 33*a* and 33*b* and sheets 22, e.g., jams. The clear key 77 may be pressed to clear, e.g., the number of printings input on the numeral keys 71. The print speed select key 79 forms a specific form of the print conveyance speed selecting means, but it is not used in this embodiment.

As shown in FIG. 2, the control means 34 is implemented as a conventional microcomputer including a CPU (Central Processing Unit) 80, an I/O (Input/Output) port, not shown, a ROM (Read Only Memory) 81, and a RAM (Random Access Memory) 82 which are interconnected by a signal bus not shown. The CPU 80 is electrically connected to the various keys and display 75 of the operation panel 70, sheet size sensors 46 and 56 so as to interchange command signals and/or ON/OFF signals and data signals therewith.

Further, the CPU 80 is electrically connected to a master make and feed drive 83 for driving the master making devices 41*a* and 41*b* and master feeding sections, not shown, a master discharge drive 84 for driving the master discharging sections 42*a* and 42*b*, a sheet feed drive 85 for driving the sheet feeding device 20, a pressure drive 86 for driving the pressing devices 32*a* and 32*b*, a sheet discharge drive 87 for driving the sheet discharging device 35 and pneumatic pressure source, not shown, and a fan drive 88 for driving the fan 18*a*. The CPU 80 interchanges command signals and/or ON/OFF signals and data signals with the above sections in order to control the entire system including the starts and stops of operation and timings.

The motors 57 and 63 are connected to the CPU 80 via drivers 89 and 90, respectively. The sensors 49 and 48 respectively sense the peripheral speed V of the belt 16*a* and the rotation speed V1 of the drum 1A and respectively send their outputs to the control means 34 via pulse detectors 91 and 92. The control means 34 writes data received from the sensors and the results of calculations output from the CPU 80 in the RAM 82 for a moment and read them out adequately.

Figure 8:
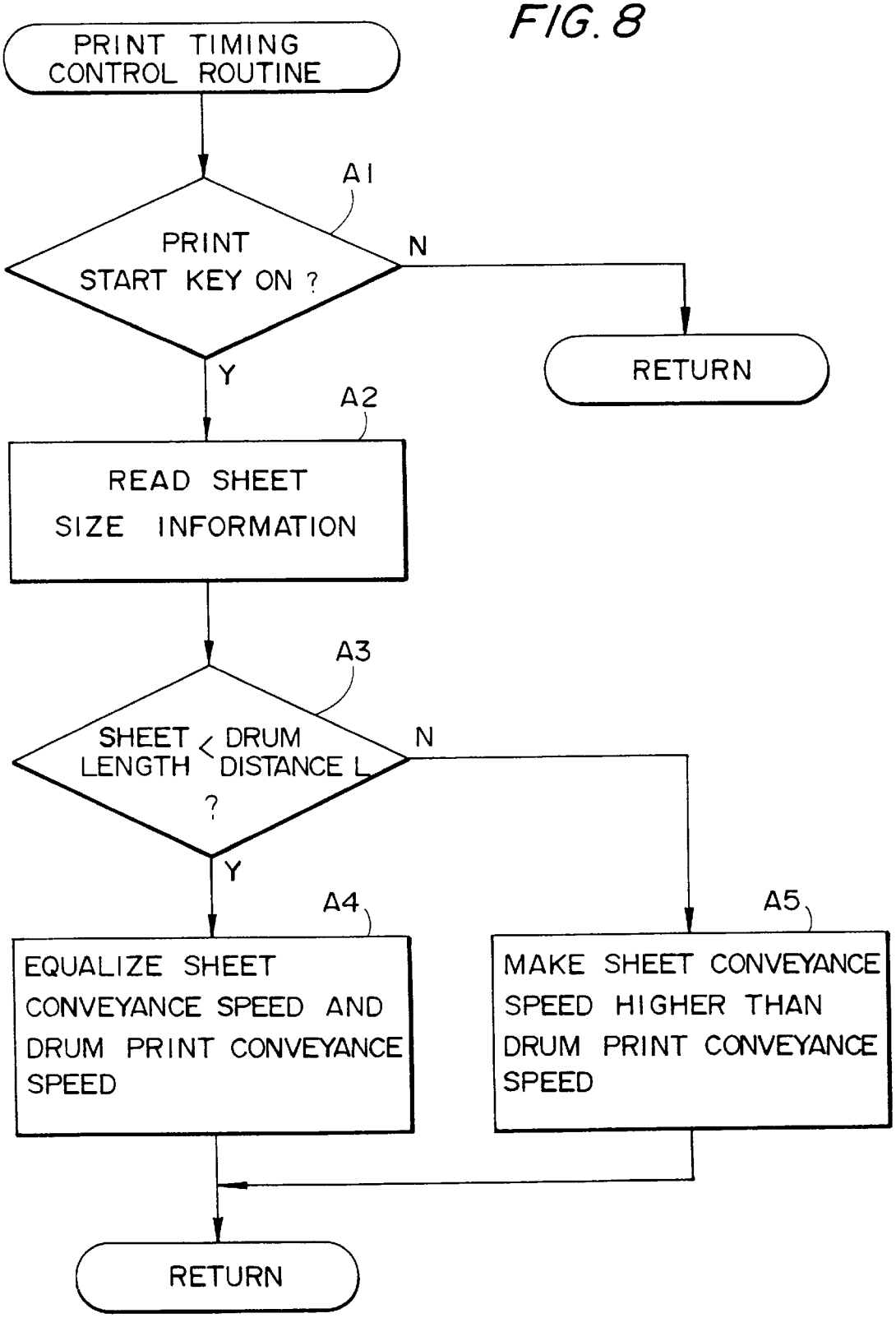
FIG. 8 is a flowchart demonstrating a print timing control routine particular to the first embodiment.

The ROM 81 stores a program and data relating to the starts, stops and timings of the various devices and drive sections, and a print timing control routine shown in FIG. 8. The data stored in the ROM 81 include a distance L (see FIG. 1) between the shafts 2*a* and 2*b* of the drums 1A and 1B and the sheet size data listed in Table 1. The distance L (referred to as a reference distance L hereinafter) corresponds to a distance between the two print positions E1 and E2.

Reference will be made to FIGS. 8–12 for describing control over the print timings particular to the above embodiment and the consecutive conditions of the sheet 22. As shown in FIG. 8, the control means 34 determines whether or not the print start key 72 is in its ON state (step A1). If the answer of the step A1 is positive (Yes), then the control means 34 determines the size and orientation of the sheets 22 by referencing the outputs of the sheet size sensors 46 and 56 or the output of the sheet size set key 47 (step A2). Subsequently, the control means 34 compares the length of the sheets 22 in the sheet conveyance direction X with the reference distance L between the print positions E1 and E2 (step A3). If the length of the sheets 22 is smaller than the reference distance L (Yes, step A3), then, the control means 34 advances to a step A4; if otherwise (No, step A3), it executes a step A5.

In this embodiment, the distance L is selected to be slightly greater than the length of a postcard. If the length of the sheets 22 is smaller than the distance L in the sheet conveyance direction X, then the control means 34 varies the frequency meant for the motor 57, i.e., the rotation of the motor 57 until the peripheral speed V of the belt 16*a* coincides with the rotation speed V1 of the drum 1A (step A4). When the peripheral speed V coincides with the rotation speed V1, as determined by the belt speed sensor 49, the control means 34 maintains it.

If the length of the sheets 22 is greater than the distance L in the sheet conveyance direction X, then the control means 34 controls the rotation of the motor 57 until the peripheral speed V of the belt 16*a* becomes about 1.2 times as high as the rotation speed V1 of the drum 1A (step A5). When the peripheral speed V exceeds the rotation speed V1, the control means 34 maintains it.

Figure 9:
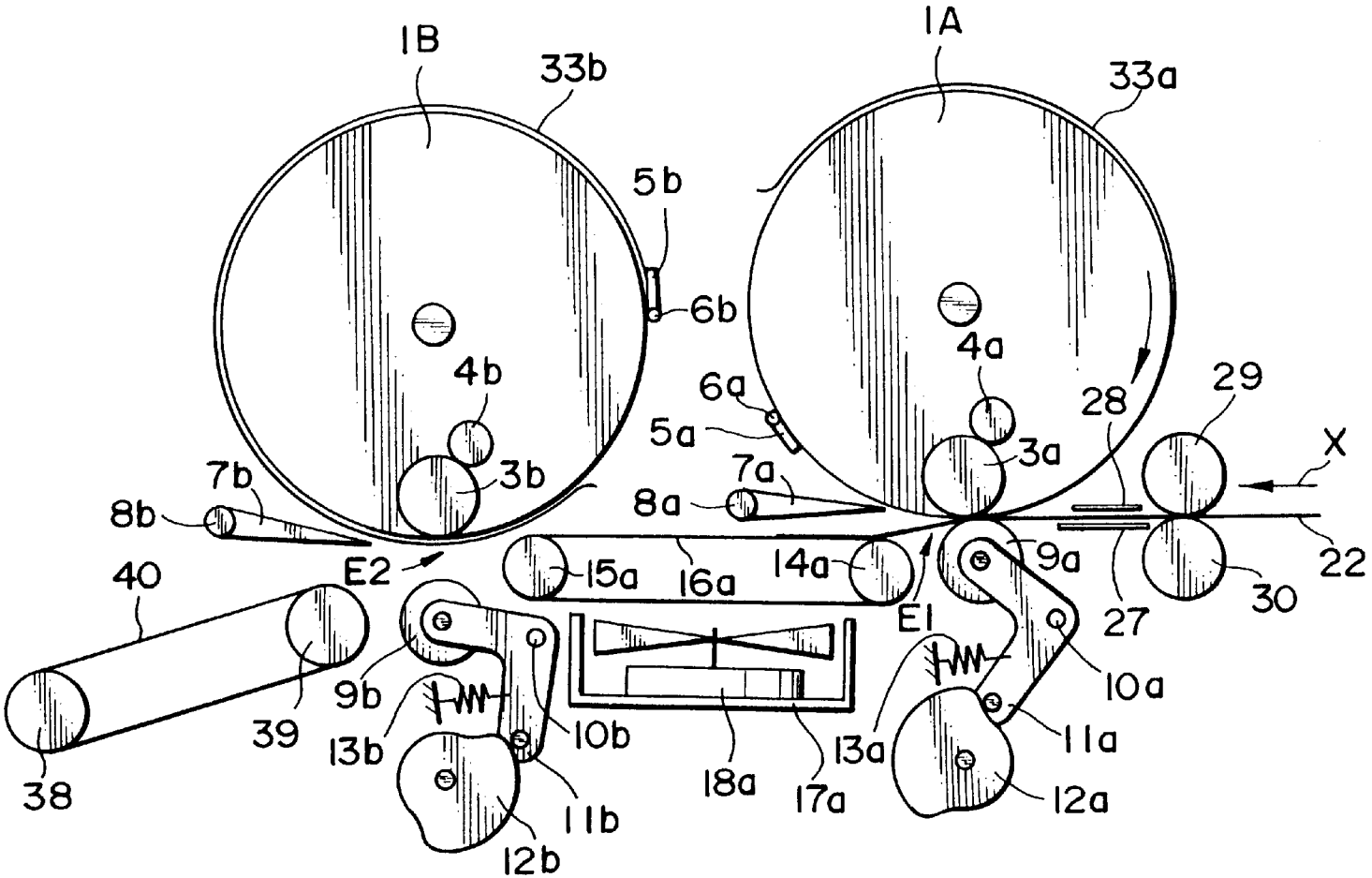
FIG. 9 is a side elevation showing the operation of the first embodiment and a sheet being peeled off from a drum in an adequate position.
Figure 10:
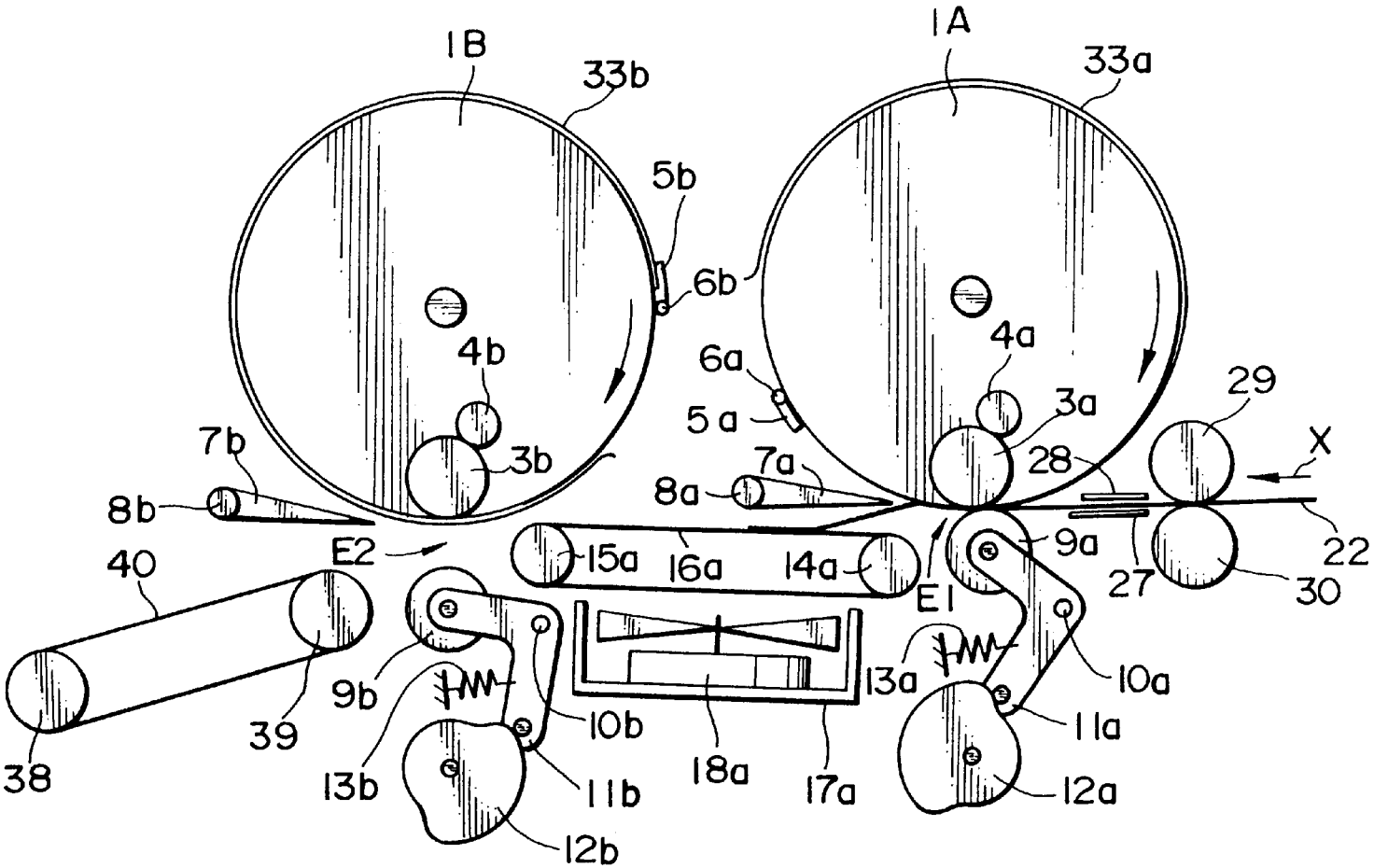
FIG. 10 is a view similar to FIG. 9, showing a sheet being peeled off at a timing later than a preselected timing.
Figure 11:
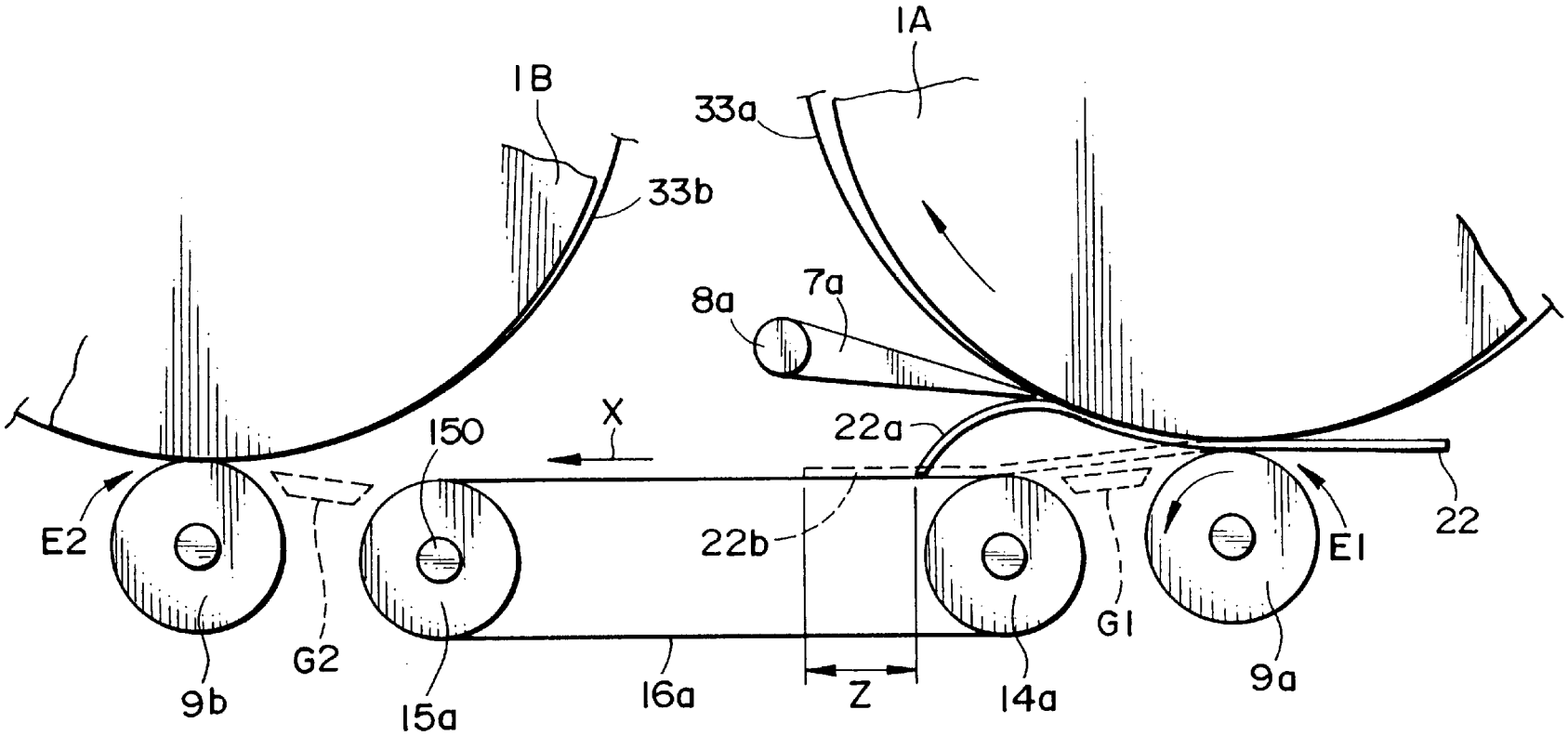
FIG. 11 is an enlarged view showing different points at which a sheet may land on the intermediate transport device.

Now, an error in the timing for feeding the sheet 22 to the print position E2 is ascribable mainly to an increase or a decrease in the amount of ink to deposit on the sheet 22 and dependent on the size of an image to be printed on the sheet 22 at the print position E1. Assume that the amount of ink and the peripheral speed V of the belt 16*a* and rotation speed V1 of the drum 1A are well balanced. Then, as shown in FIG. 9, the sheet 22 at the print position E1 is peeled off from the drum 1A by the air knife 7*a* as soon as it moves away from the press roller 9*a*, and is immediately sucked onto the belt 16*a* and conveyed to the print position E2 thereby. However, as shown in FIG. 10, when the above two kinds of factors are unbalanced, the sheet 22 is not immediately peeled off from the drum 1A even after it has moved away from the print position E1, but is peeled off by the edge of the air knife 7*a*. As a result, the leading edge of the sheet 22 slackens above the belt 1 6*a*. It follows that, as shown in FIG. 11, the sheet 22 lands on the belt 16*a* at a position different from the expected position shown in FIG. 9. Consequently, the feed of the sheet 22 to the print position E2 is delayed by an interval Z. In FIG. 11, the leading edge of the sheet 22 delayed by the above interval Z and that of the sheet 22 conveyed at the adequate timing are labeled 22*a* and 22*b*, respectively.

Figure 12:
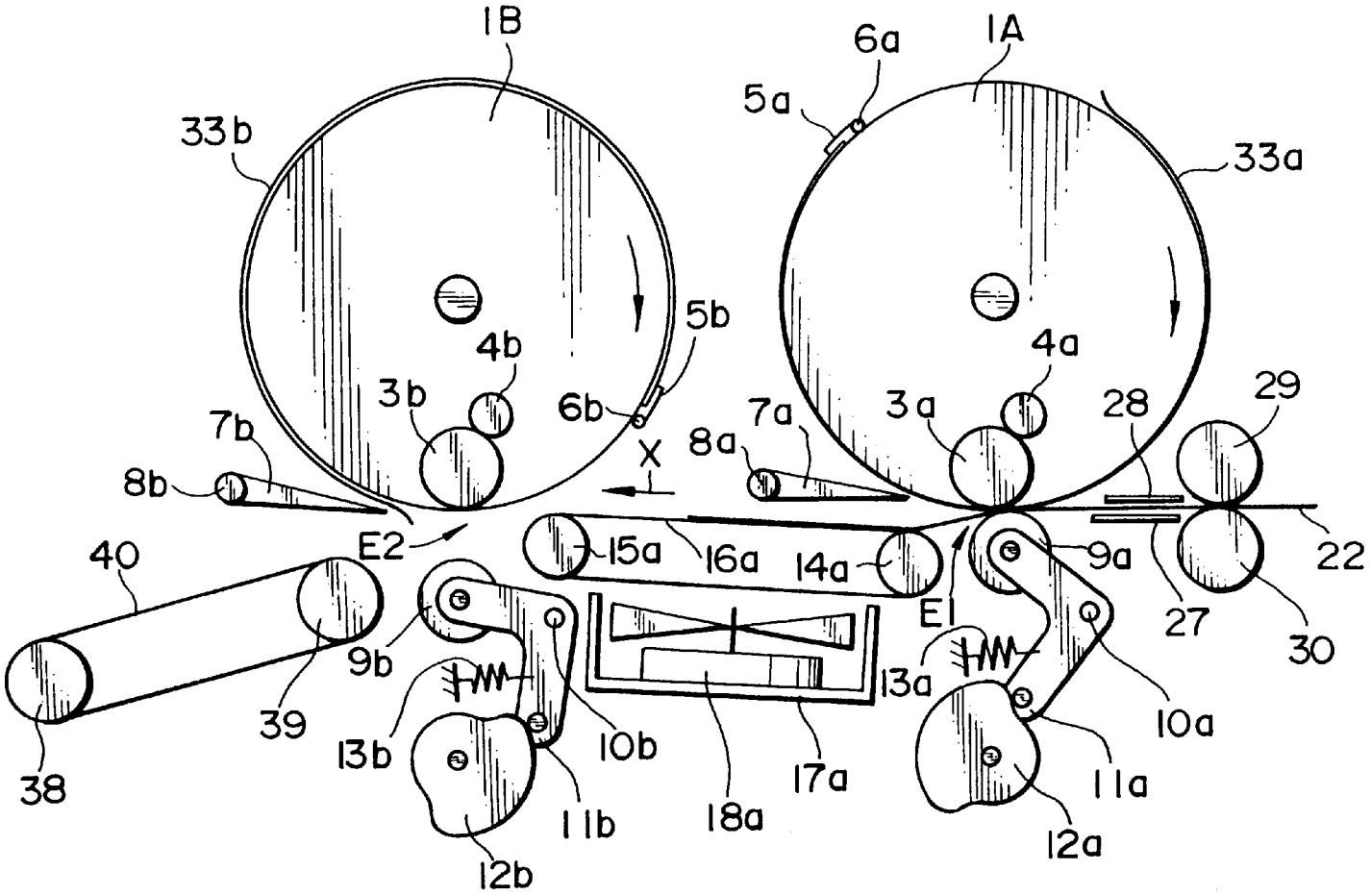
FIG. 12 is a side elevation showing how the intermediate transport device conveys a sheet.

When the size of the image to be printed on the sheet 22 at the print position E1 is great and delays the separation of the sheet 22 from the drum 1A, the illustrative embodiment drives the belt 16*a* at a peripheral speed V about 1.2 times as high as the rotation speed V1 of the drum 1A. As a result, the leading edge 22*a* of the sheet 22 is rapidly conveyed toward the print position E2. At this instant, the trailing edge of the sheet 22 is still held between the press roller 9*a* and the drum 1A at the print position E1, i.e., printing is under way. Therefore, as shown in FIG. 12, the slackened sheet 22 is conveyed with its leading edge straightened. This successfully obviates irregularity in the position of the leading edge of the sheet 22, i.e., corrects the timing for feeding the sheet 22 to the print position E2 and thereby obviates double printing discussed earlier.

So long as the sheet 22 moving away from the press roller 9*a* is elastic enough, its leading edge can be smoothly conveyed to the belt 16*a* above the roller 14*a* without resorting to a guide. However, when the elasticity of the sheet 22 is short, the leading edge of the sheet 22 may fail to reach the belt 16*a* above the roller 14*a*. In light of this, a guide G1 indicated by a phantom line in FIG. 11 may be used. This problem is also true with the transfer of the sheet 22 from the belt 16*a* to the top of the press roller 9*b*. If the elasticity of the sheet 22 is short, a guide G2 also indicated by a phantom line in FIG. 11 may be positioned between the belt 16*a* and the press roller 9*b*.

Assume that the peripheral speed V of the belt 16*a* is higher than the rotation speed V1 of the drum 1A. Then, when the size of the sheet 22 is smaller than the distance L, i.e., when the size of the image to be printed on the sheet 22 at the print position E1 is small, the sheet 22 is fed to the print position E2 earlier than expected. Consequently, the leading edge of the image printed on the sheet 22 at the print position E1 is brought out of register with the leading edge of the image on the drum 1B at the print position E2. As shown in FIG. 8, when the length of the sheet 22 is smaller than the distance L, the illustrative embodiment reduces the peripheral speed V of the belt 16*a* until it coincides with the rotation speed V1 of the drum 1A (steps A3 and A4, FIG. 8). Such deceleration corrects the timing for feeding the sheet 22 to the print position E2 and thereby obviates the above occurrence.

As stated above, the transport motor 57 is so controlled as to correct the peripheral speed V of the belt 16*a* in accordance with the length of the sheet 22. It is therefore possible to adjust the timing for feeding the sheet 22 to the print position E2 in accordance with the sheet size, and therefore to obviate double printing and misregister.

The control means 34 automatically identifies the size of the sheet 22 on the basis of the outputs of the sheet size sensors 46 and 56 (step A3). This allows the peripheral speed V of the belt 16*b* to be automatically corrected and thereby frees the operator from troublesome operation. In addition, when any one of the sensors 46 and 56 fails, the sheet size set key 47 allows the operator to manually set the size of the sheet 22 and thereby enhances reliability.

When the operator presses the conveyance speed select key 50, the control routine shown in FIG. 8 can be executed by an interrupt. This, coupled with the fact that the operator can vary the frequency meant for the transport motor 57 on the speed adjust key 78, allows the operator to adjust the peripheral speed V of the belt 16*a* if a printing produced by the routine of FIG. 8 is out of register.

In the above embodiment, the peripheral speed V of the belt 16*a* is varied by varying the frequency meant for the transport motor 57. Alternatively, a gear train, a pulley group or similar speed changing means may be provided between the motor 57 and the shaft 150 of the drive roller 15*a* and driven in accordance with the size of the sheet 22.

If desired, the sheet 22 may be conveyed from the print position E1 to the print position over a distance greater than the distance L. Then, the sheet 22 will not bridge the two print positions E1 and E2 and will therefore suffer from a minimum of defects even when the peripheral speeds of the drums 1A and 1B are not identical. For example, at least one of the opposite ends of the conveying surface of the intermediate transport device 17*a* adjoining the print positions E1 and E2, respectively, may be positioned below a base line connecting the two positions E1 and E2. In this configuration, even when the sheet 22 being conveyed bridges the two print positions E1 and E2, it is prevented from being pulled in the sheet conveyance direction X.

2nd Embodiment

A second embodiment of the present invention will be described with reference to FIGS. 13–15. This embodiment is practicable with the same mechanical arrangements as the first embodiment, so that identical structural elements are denoted by identical reference numerals and will not be described specifically. As shown, the second embodiment is characterized in that a sheet sensor or leading edge sensing means 95 senses the leading edge of the sheet 22, and that the peripheral speed V of the belt 16*a* is varied in accordance with the output of the sensor 95 in order to control the timing for feeding the sheet 22 to the print position E2.

Figure 13:
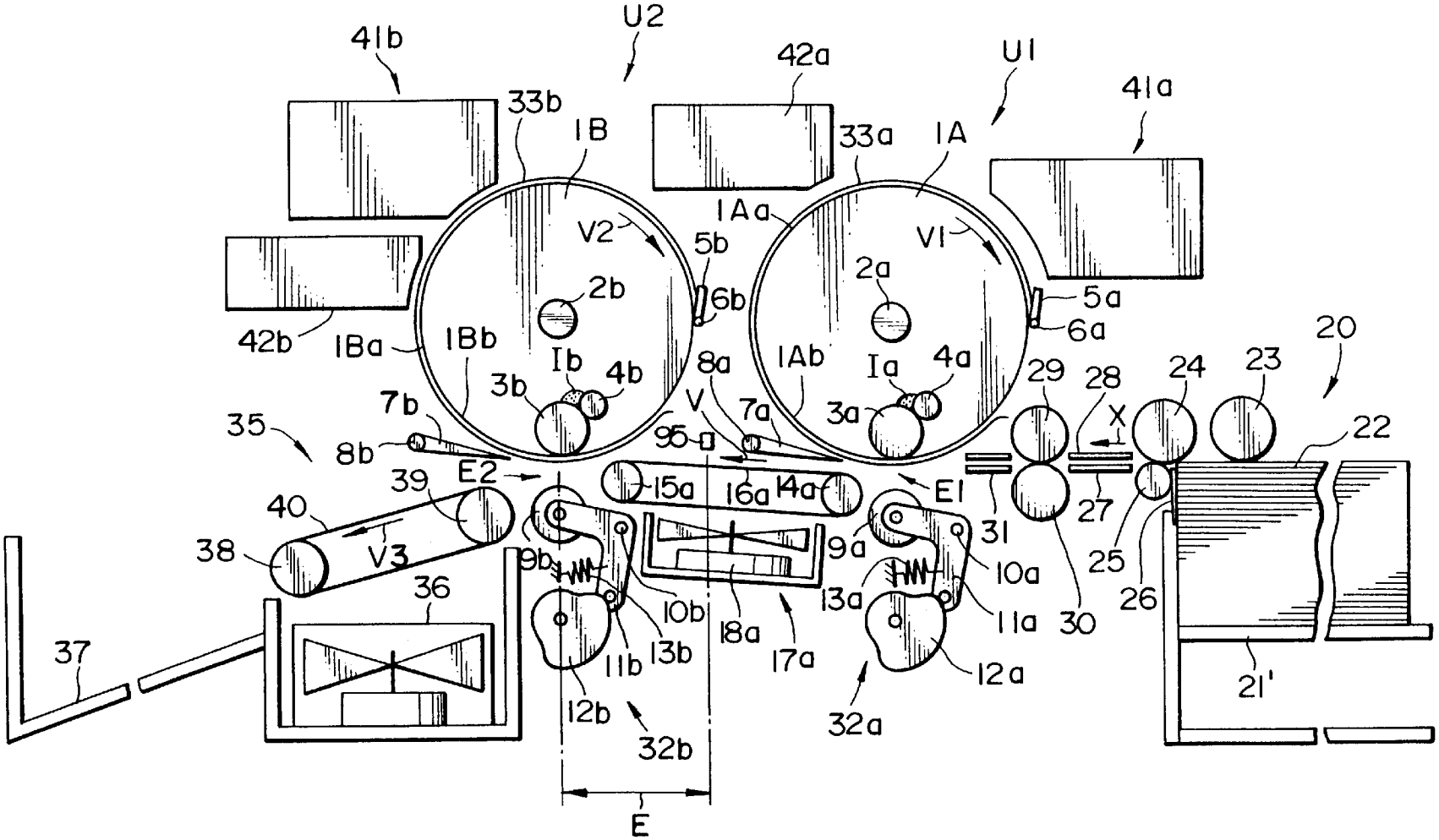
FIG. 13 shows the general construction of a second embodiment of the present invention.
Figure 14:
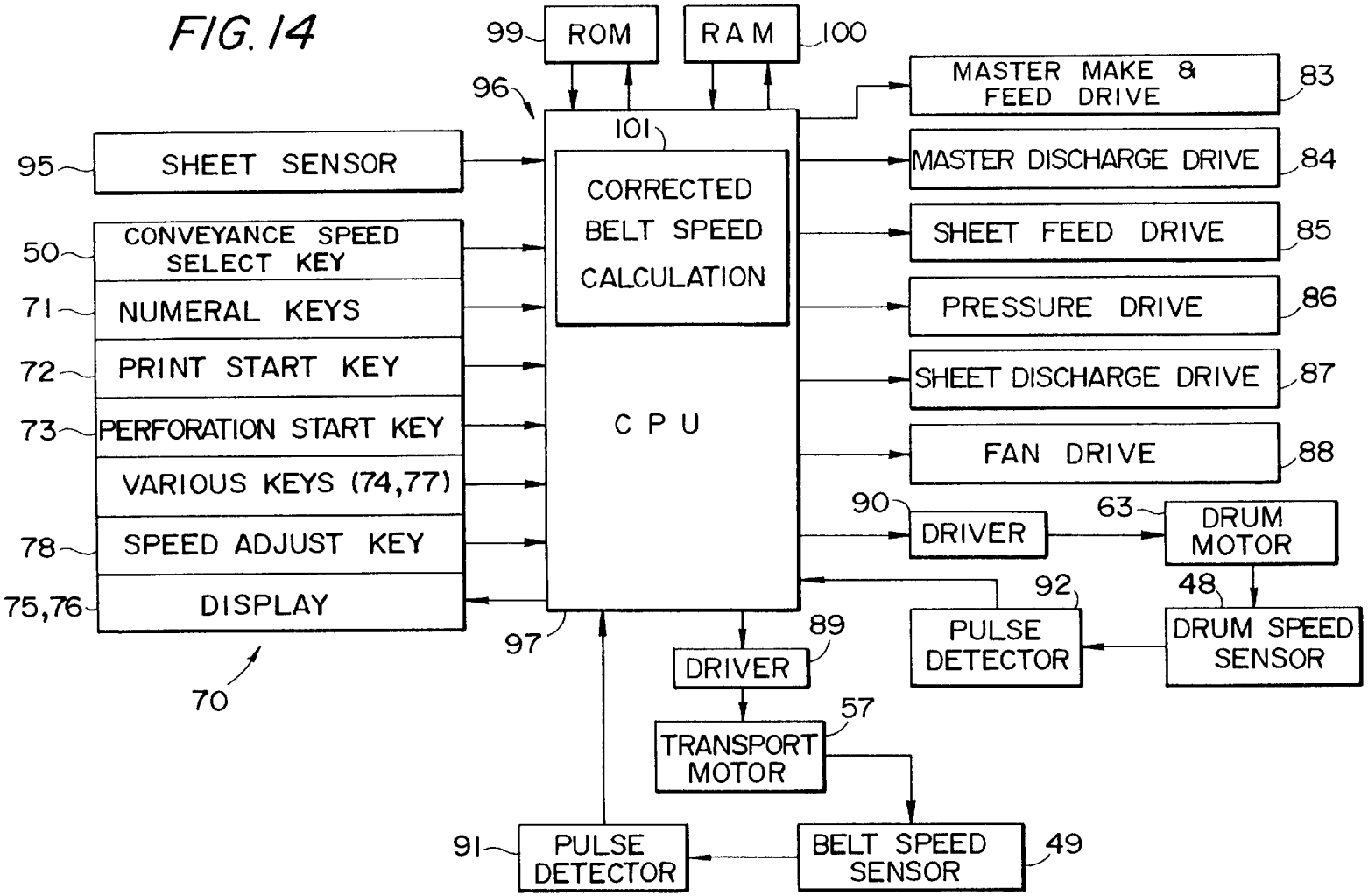
FIG. 14 is a block diagram schematically showing control means included in the second embodiment.

As shown in FIG. 13, the sheet sensor 95 is mounted on the printer housing substantially above the intermediate portion of the belt 16*a*. The sheet sensor 95 is a conventional reflection type sensor having a light emitting element and a light-sensitive element arranged to face the belt 16*a*. As shown in FIG. 14, the sheet sensor 95 is electrically connected to control means 96 and feeds its output to the control means 96 while sensing the sheet 22 being conveyed. In this embodiment, the sheet feeding device 20 includes a sheet tray 21 different from the sheet tray 21 in that the sheet size sensors 46 and 56 are absent.

The control means 96 is also implemented as a conventional microcomputer including a CPU 97, an I/O port, not shown, a ROM 99, and a RAM 100 which are interconnected by a signal bus not shown.

The CPU 97 is connected to the drum speed sensor 48 responsive to the rotation speed V2 of the downstream drum 1B, belt speed sensor 49 responsive to the peripheral speed of the belt 16*a*, and conveyance speed select key 50 and speed adjust key 78 playing the role of manual sheet conveyance speed selecting means. In this embodiment, the peripheral speed of the belt 16*a* is equal to the rotation speed V1 of the upstream drum 1A.

The drum speed sensor 48 is implemented by a conventional rotary encoder mounted on the output shaft of the drum motor 63 and feeds its output to the control means 96. The drum motor 63 is drivably connected to the drums 1A and 1B via a driveline, not shown, and causes the drums 1A and 1B to rotate at the same speed. In this configuration, the drum speed sensor 48 senses the rotation speed V1 of the drum and the rotation speed V2 of the drum 1B. The control means 96 causes the drum motor 63 to start rotating in synchronism with the registration timing of the registration rollers 29 and 30.

Further, the CPU 97 is connected to the numeral keys 71, print start key 72, perforation start key 73, stop key 74, display 75, monitor display 76 and clear key 77 arranged on the operation panel 70, the conveyance speed select key 50 which gives priority to manual speed setting, and the speed adjust key 78, i.e., down key 78*a* and up key 78*b*. In addition, the CPU 97 is electrically connected to the master make and feed drive 83, master discharge drive 84, sheet feed drive 85, pressure drive 86, sheet discharge drive 87 and fan drive 88 so as to interchange command signals and/or ON/OFF signals and data signals therewith, thereby controlling the entire system including the starts and stops of operation and timings.

The motors 57 and 63 are connected to the control means 96 via the drivers 89 and 90, respectively. The sensors 49 and 48 respectively sense the operating conditions of the motors 57 and 63, i.e., the peripheral speed V of the belt 16*a* and the rotation speed V2 of the drum 1B and respectively send their outputs to the control mans 96 via the pulse detectors 91 and 92. The control means 96 writes data received from the sensors and the results of calculations output from the CPU 97 in the RAM 100 for a moment and reads them out adequately.

Figure 15:
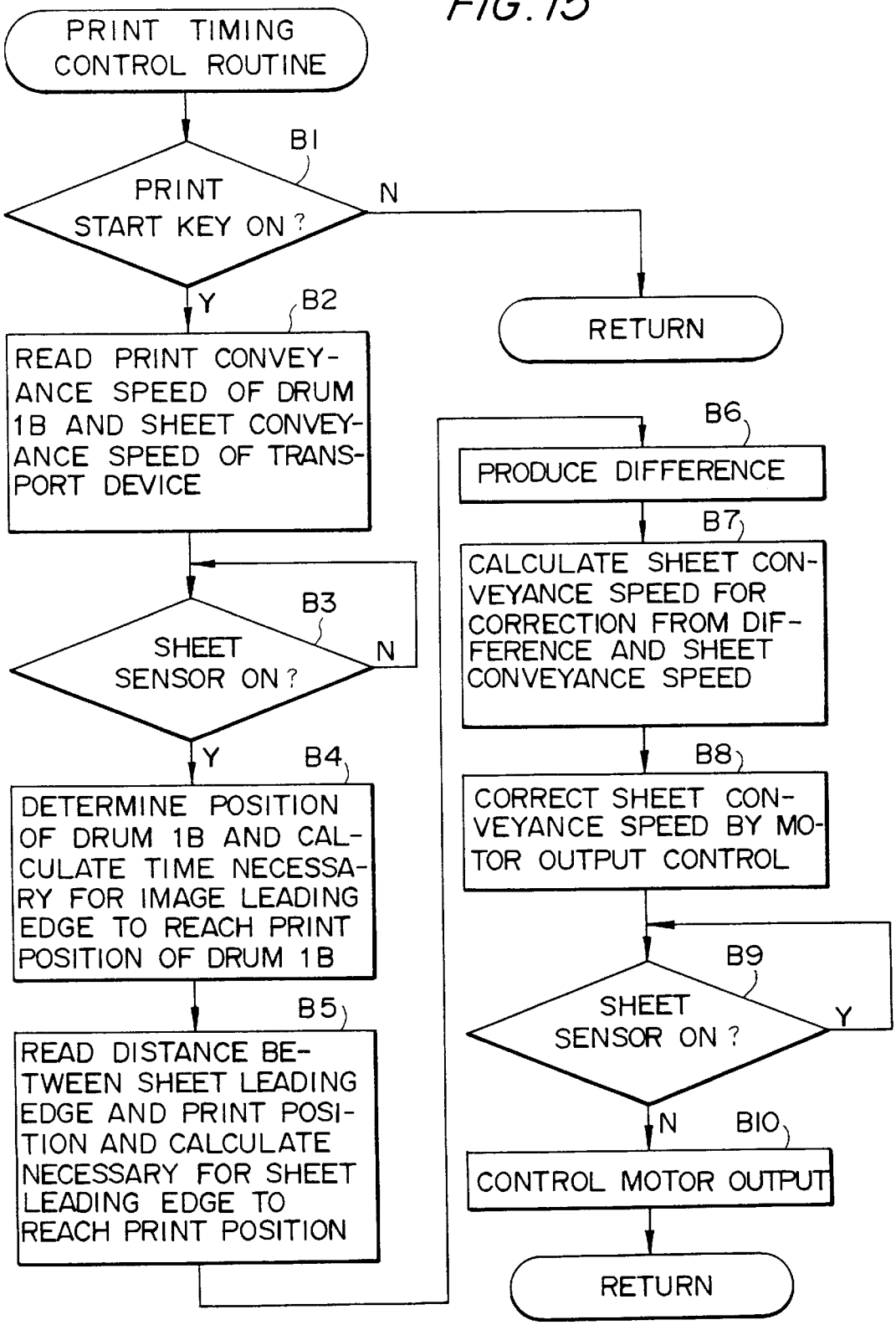
FIG. 15 is a flowchart demonstrating a print timing control routine particular to the second embodiment.

The ROM 99 stores a program and data relating to the starts, stops and timings of the various devices and drive sections, and a print timing control routine shown in FIG. 15. The ROM 99 additionally stores distance data E representative of the distance between the sheet sensor 95 and the print position E2 assigned to the downstream drum 1B. In the illustrative embodiment, the CPU 97 includes a corrected belt speed calculation 101 serving as a sheet conveyance control section. The corrected belt speed calculation 101 calculates, by using the ON output of the sheet sensor 95 as a trigger, a peripheral speed V of the belt 16*a* which allows the leading edge of the image on the drum 1B and the leading edge of the sheet 22 meet at the print position E2.

Print timing control particular to this embodiment will be described with reference to FIG. 15. As shown, the control means 96 determines whether or not the print start key 72 is in its ON state (step B1). If the answer of the step B1 is Yes, the control means 96 drives the various sections of the printer. As a result, the drums 1A and 1B and belt 16*a* each is rotated at a constant speed while the sheet 22 is fed from the sheet feeding device 20 toward the print position E1 at a preselected timing. At the same time, the press rollers 9*a* and 9*b* are brought into contact with the drums 1A and 1B, respectively. The sheet 22 with an image printed thereon at the print position E1 is transported toward the print position E2 by the belt 16*a* while being retained thereon by suction, as in the previous embodiment.

The control means 96 writes the rotation speed V2 of the drum 1B and the peripheral speed V of the belt 16*a* respectively represented by the outputs of the sensors 48 and 49 in the RAM 100 (step B2). Then, the control means 96 determines whether or not the sheet sensor 95 has sensed the leading edge of the sheet 22 (step B3). At the time when the sheet sensor 95 senses the leading edge of the sheet 22 (Yes, step B3), the control means 96 determines the position of the leading edge of the image on the drum 1B on the basis of the output of the drum speed sensor 48, and calculates a period of time necessary for the leading edge to reach the print position E2 (step B4).

After the step B4, the control means 96 reads the distance data E representative of the distance between the sheet sensor 95 and the center of the print position E2 out of the ROM 99. Then, the control means 96 calculates a period of time necessary for the leading edge of the sheet 22 to reach the print position E2 by using the distance data E and the peripheral speed V of the belt 16*a* stored in the RAM 100. These steps are collectively represented by a step B5. Subsequently, the control means 96 produces a difference between the periods of time calculated in the steps B4 and B5 (step B6). Of course, the steps B4 and B5 may be replaced with each other.

The control means 96 calculates, based on the difference produced in the step B6 and the peripheral speed V of the belt 16*a*, a peripheral speed of the belt 16*a* which is a sheet conveyance speed for correction (step B7). Then, the control means 96 varies the frequency meant for the motor 57 until the peripheral speed V of the belt 16*a* coincides with the sheet conveyance speed for correction (step B8). Specifically, the control means 96 raises the peripheral speed V if the arrival of the sheet 22 at the print position E2 will be delayed, or lowers it if the arrival will be advanced.

After the step B8, the control means 96 determines whether or not the sheet sensor 95 is still in its ON state (step B9). When a preselected period of time elapses since the turn-off of the sheet sensor 95 (No, step B9), the control means 96 determines that the sheet 22 has disappeared from the belt 16*a*. Subsequently, the control means 96 so controls the motor 57 as to restore the belt 16*a* to its initial peripheral speed and prepares for the next sheet 22 (step B10).

As stated above, even when the landing point of the sheet 22 on the belt 16*a* is disturbed by irregularity in the size of an image to be printed on the sheet 22 at the print position E1, this embodiment is capable of correcting the timing for feeding the sheet 22 to the print position E2 so as to obviate double printing and misregister. This makes it needless to set or sense a sheet size or to store sheet data and thereby simplifies the construction while reducing a load on a memory. The illustrative embodiment restores the belt 16*a* to its initial peripheral speed V as soon as the sheet 22 disappears from the belt 16*a*, as stated earlier. Therefore, when the peripheral speed V of the belt 16*a* is increased for correction, the wasteful power consumption of the motor 57 is obviated. This contributes to the energy saving of the printer.

When the operator presses the conveyance speed select key 50, the control routine shown in FIG. 15 can be executed by an interrupt. This, coupled with the fact that the operator can vary the frequency meant for the motor 57 on the speed adjust key 78, allows the operator to adjust the peripheral speed V of the belt 16*a* if a printing produced by the routine of FIG. 15 is out of register.

In the illustrative embodiment, the rotation speed V1 of the drum 1A and the peripheral speed V of the belt 16*a* equal to each other. Alternatively, the peripheral speed may be selected to be about 1.2 times as high as the rotation speed V1, as in the first embodiment, so as to prevent the basic timing for feeding the sheet 22 to the print position E2 from being delayed.

Moreover, assume that the size or the coefficient of friction of the sheet 22 or the viscosity of the ink is varied due to humidity or temperature, preventing the belt 16*a* moving at its initial peripheral speed V from feeding the sheet 22 to the print position E2 at the expected timing. Even in such a condition, it is possible to control the peripheral speed V and therefore the above timing by using the routine shown in FIG. 15. This obviates double printing or misregister more positively.

3rd Embodiment

A third embodiment of the present invention will be described with reference to FIGS. 13, 16 and 17. This embodiment is practicable with the same mechanical arrangements as the second embodiment, so that identical structural elements are denoted by identical reference numerals and will not be described specifically. This embodiment is characterized in that the rotation speed V2 of the drum 1B is varied in accordance with the output of the sheet sensor 95 responsive to the leading edge of the sheet 22. This is also successful to cause the leading edge of the sheet 22 and the leading edge of an image on the drum 1B to meet at the print position E2. For this purpose, as shown in FIG. 16, the drums 1A and 1B are respectively driven by a first drum motor 110 and a second drum motor 111, i.e., each of them is driven by a respective driveline.

Figure 16:
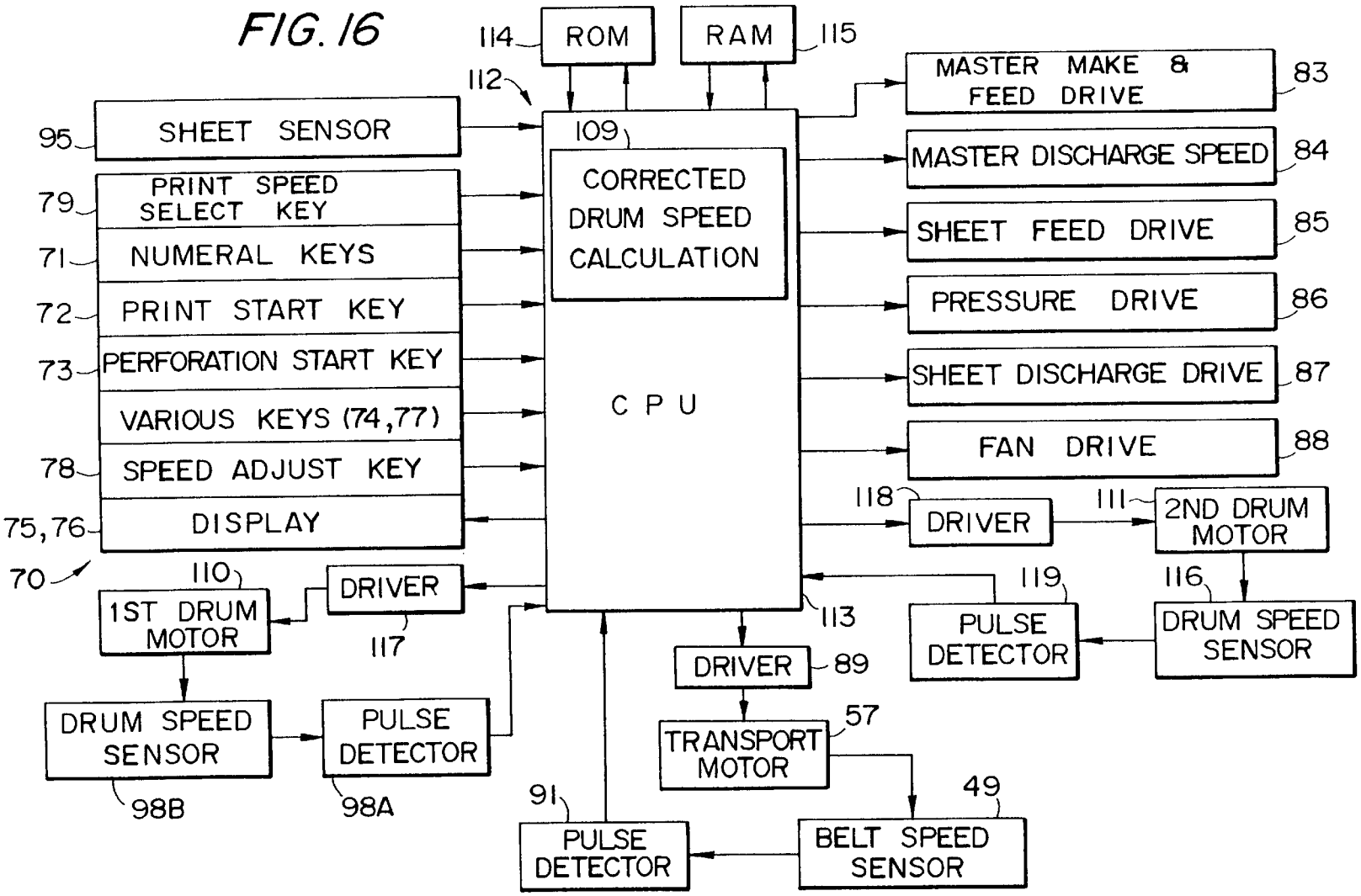
FIG. 16 is a block diagram schematically showing control means representative of a third embodiment of the present invention.

Specifically, as shown in FIG. 16, the sheet sensor 95 is connected to control means 112 and feeds its output to the control means 112 while sensing the sheet 22. The drum motors 110 and 111 are electrically connected to the control means 112 via drivers 117 and 118, respectively.

The control means 112 is also implemented as a conventional microcomputer including a CPU 113, an I/O port, not shown, a ROM 114, and a RAM 115 which are interconnected by a signal bus not shown.

The CPU 113 is connected to a drum speed sensor or print speed sensing means 116 responsive to the rotation speed V2 of the downstream drum 1B, a drum speed sensor or another print speed sensing means 98B responsive to the rotation speed V1 of the upstream drum 1A, the belt speed sensor 49 responsive to the peripheral speed V of the belt 16*a*, and a print speed select key 79 and the speed adjust key 78 playing the role of print conveyance speed selecting means. The print conveyance speed selecting means allows the rotation speed V2 of the drum 1B to be selected by the operator.

The drum speed sensor 116 is implemented by a conventional rotary encoder mounted on the output shaft of the second drum motor 111 and feeds its output to the control means 112 via a pulse detector 119. Likewise, the drum speed sensor 98B is a rotary encoder mounted on the output shaft of the first drum motor 110 and feeds its output to the control means 112 via a pulse detector 98A.

The control means 112 drives the two drum motors 110 and 111 such that the drums 1A and 1B rotate at the same speed. Also, the control means 112 causes the drum motors 110 and 111 to start rotating in synchronism with the registration timing of the registration rollers 29 and 30. While the drum speed sensors 98B and 116 are respectively mounted on the output shafts of the drum motors 110 and 111, they may, of course, be mounted on the shafts of the drums 1A and 1B, respectively.

Further, the CPU 113 is connected to the numeral keys 71, print start key 72, perforation start key 73, stop key 74, display 75, monitor display 76 and clear key 77 arranged on the operation panel 70, print speed select key or print conveyance speed selecting means 79 for giving priority to manual print speed setting, and speed adjust key 78, i.e., down key 78*a* and up key 78*b*. With the speed adjust key 78, the operator can freely select the object whose speed should be varied by means of the conveyance speed select key 50 or print speed select key 79.

In addition, the CPU 113 is electrically connected to the master make and feed drive 83, master discharge drive 84, sheet feed drive 85, pressure drive 86, sheet discharge drive 87 and fan drive 88 so as to interchange command signals and/or ON/OFF signals and data signals therewith, thereby controlling the entire system including the starts and stops of operation and timings.

The motor 57 is connected to the control means 112 via the driver 89. The sensor 49 senses the operating condition of the motor 57, i.e., the peripheral speed V of the belt 16*a* and sends the output to the control means 112 via the pulse detector 91. The control means 112 writes data received from the sensors and the results of calculations output from the CPU 113 in the RAM 115 for a moment and reads them out adequately.

Figure 17:
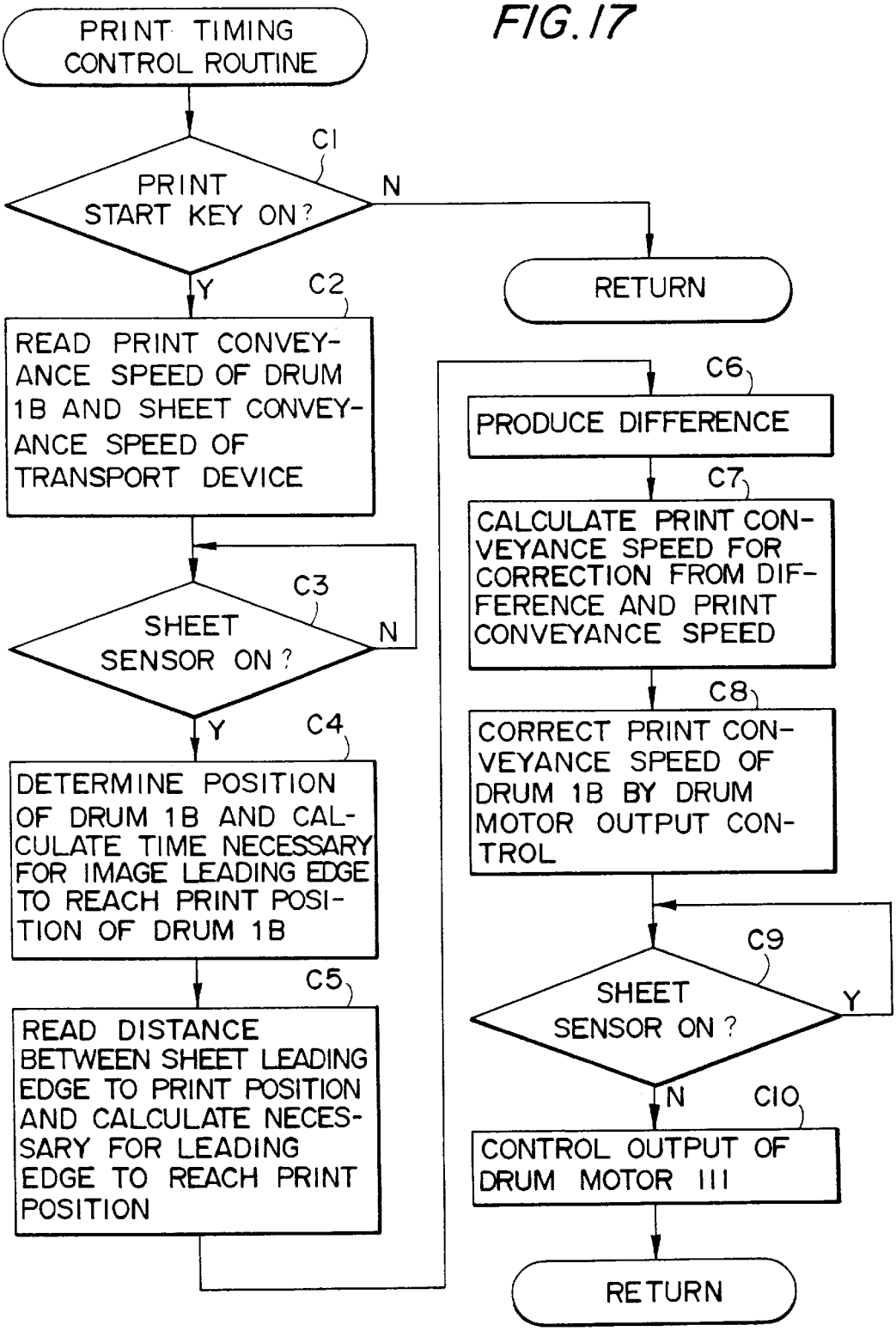
FIG. 17 is a flowchart representative of a print timing control routine particular to the third embodiment.

The ROM 114 stores a program and data relating to the starts, stops and timings of the various devices and drive sections, and a print timing control routine shown in FIG. 17. The ROM 114 additionally stores distance data E representative the distance between the sheet sensor 95 and the print position E2 assigned to the downstream drum 1B. In the illustrative embodiment, the CPU 113 includes a corrected drum speed calculation 109 serving as a sheet conveyance speed control section. The corrected drum speed calculation 109 calculates, by using the ON output of the sheet sensor 95 as a trigger, a rotation speed of the drum 1B which allows the leading edge of the image on the drum 1B and the leading edge of the sheet 22 meet at the print position E2.

Referring to FIG. 17, the control means 112 determines whether or not the print start key 72 is in its ON state (step C1). If the answer of the step C1 is Yes, the control means 112 drives the various sections of the printer. As a result, the drums 1A and 1B and belt 16*a* each is rotated at a constant speed while the sheet 22 is fed from the sheet feeding device 20 toward the print position E1 at a preselected timing. At the same time, the press rollers 9*a* and 9*b* are brought into contact with the drums 1A and 1B, respectively. The sheet 22 with an image printed thereon at the print position E1 is transported toward the print position E2 by the belt 16*a* while being retained thereon by suction.

The control means 112 writes the rotation speed V2 of the drum 1B and the peripheral speed V of the belt 16*a* respectively represented by the outputs of the sensors 116 and 49 in the RAM 115 (step C2). Then, the control means 112 determines whether or not the sheet sensor 95 has sensed the leading edge of the sheet 22 (step C3). At the time when the sheet sensor 95 senses the leading edge of the sheet 22 (Yes, step C3), the control means 112 determines the position of the leading edge of the image on the drum 1B on the basis of the output of the drum speed sensor 116, and calculates a period of time necessary for the leading edge to reach the print position E2 (step C4).

After the step C4, the control means 112 reads the distance data E representative of the distance between the sheet sensor 95 and the center of the print position E2 out of the ROM 114. Then, the control means 112 calculates a period of time necessary for the leading edge of the sheet 22 to reach the print position E2 by using the distance data E and the peripheral speed V of the belt 16*a* stored in the RAM 115. These steps are collectively represented by a step C5. Subsequently, the control means 112 produces a difference between the periods of time calculated in the steps C4 and C5 (step C6). Of course, the steps C4 and C5 may be replaced with each other.

The control means 112 calculates, based on the difference produced in the step C6 and the rotation speed V2 of the drum 1B, a rotation speed of the drum 1B which is a print conveyance speed for correction (step C7). Then, the control means 112 varies the frequency meant for the second drum motor 111 until the rotation speed V2 of the drum 1B coincides with the print conveyance speed for correction (step C8). Specifically, the control means 112 lowers the rotation speed of the drum 1B if the arrival of the sheet 22 at the print position E2 will be delayed, or raises it if the arrival will be advanced.

After the step C8, the control means 112 determines whether or not the sheet sensor 95 is still in its ON state (step C9). When a preselected period of time elapses since the turn-off of the sheet sensor 95 (No, step C9), the control means 112 determines that the sheet 22 has disappeared from the belt 16*a*. Subsequently, the control means 112 so controls the second drum motor 111 as to restore the drum 1B to its initial rotation speed V2 and prepares for the next sheet 22 (step C10).

As stated above, even when the landing point of the sheet 22 on the belt 16*a* is disturbed by irregularity in the size of an image to be printed on the sheet 22 at the print position E1, this embodiment is capable of correcting the timing for the drum 1B to reach the print position E2 so as to obviate double printing and misregister. This makes it needless to set or sense a sheet size or to store sheet data and thereby simplifies the construction while reducing a load on a memory. The illustrative embodiment restores the drum 1B to its initial rotation speed V2 as soon as the sheet 22 disappears from the belt 16*a*, as stated earlier. Therefore, when the rotation speed V2 of the drum 1B is increased for correction, the wasteful power consumption of the second drum motor 111 is obviated. This contributes to the energy saving of the printer.

When the operator presses print speed select key 79, the control routine shown in FIG. 17 can be executed by an interrupt. This, coupled with the fact that the operator can vary the frequency meant for the second drum motor 111 on the speed adjust key 78, allows the operator to adjust the rotation speed V2 of the drum 1B if a printing produced by the routine of FIG. 17 is out of register.

In the illustrative embodiment, the rotation speed V1 of the drum 1A and the peripheral speed V of the belt 16*a* are equal to each other. Alternatively, the peripheral speed V may be selected to be about 1.2 times as high as the rotation speed V1, as in the first embodiment, so as to prevent the basic timing for feeding the sheet 22 to the print position E2 from being delayed.

Moreover, assume that the size or the coefficient of friction of the sheet 22 or the viscosity of the ink is varied due to humidity or temperature, preventing the belt 16*a* moving at its initial peripheral speed V from feeding the sheet 22 to the print position E2 at the expected timing. Even in such a condition, it is possible to control the rotation speed V2 and therefore the above timing by using the routine shown in FIG. 17. This obviates double printing or misregister more positively.

4th Embodiment

Figure 18:
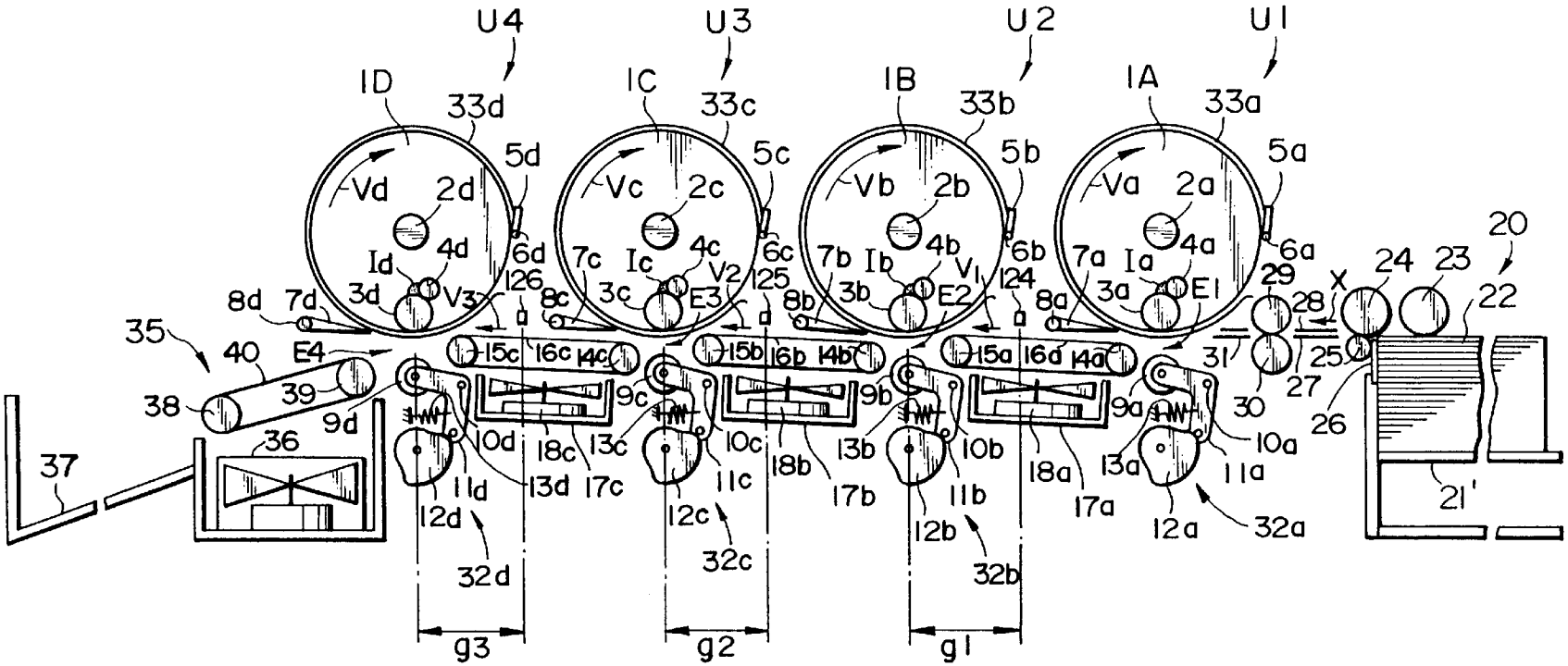
FIG. 18 shows the general construction of a fourth embodiment of the present invention.
Figure 19:
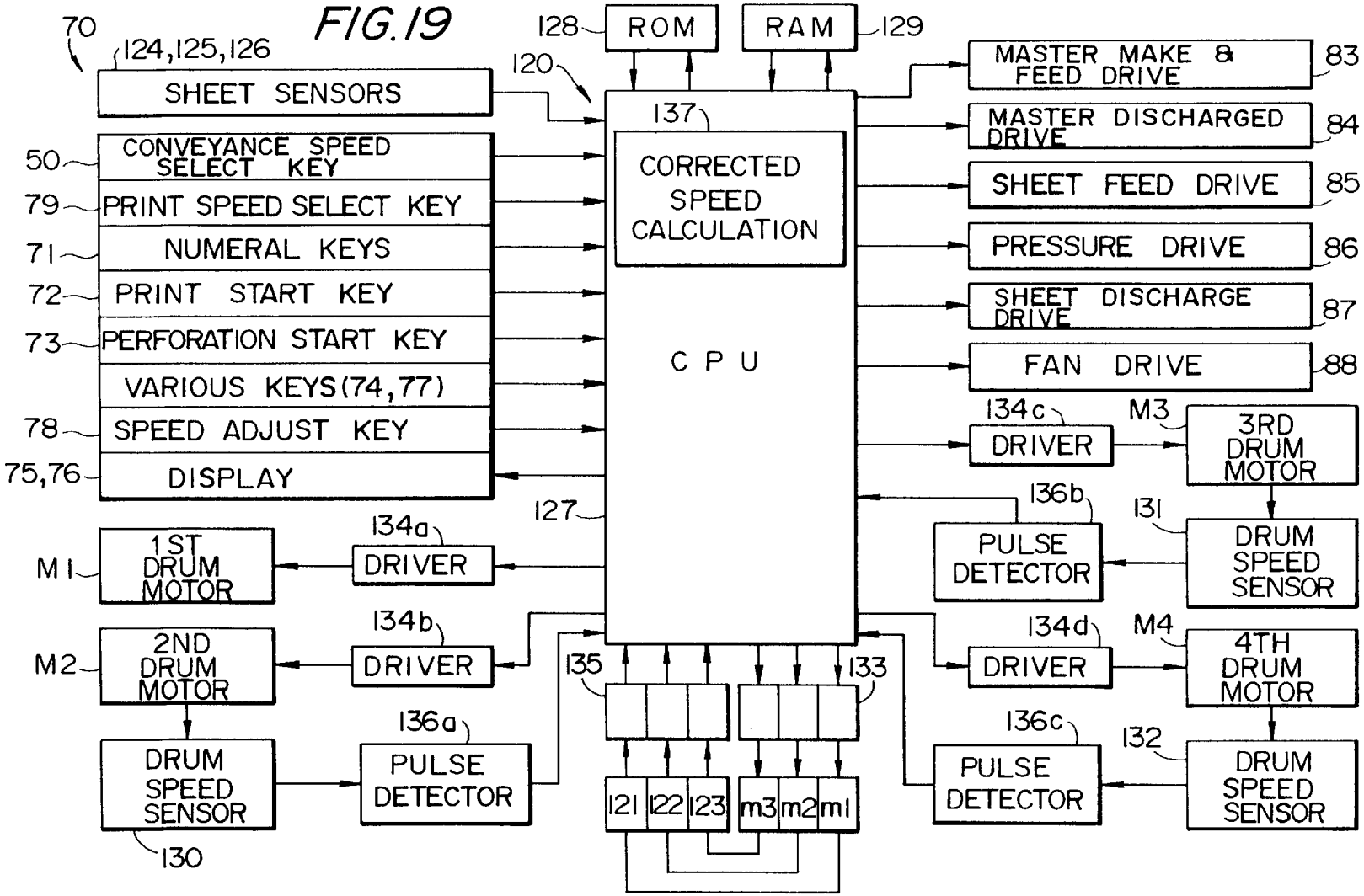
FIG. 19 is a block diagram showing control means included in the fourth embodiment.
Figures 20, 20A:
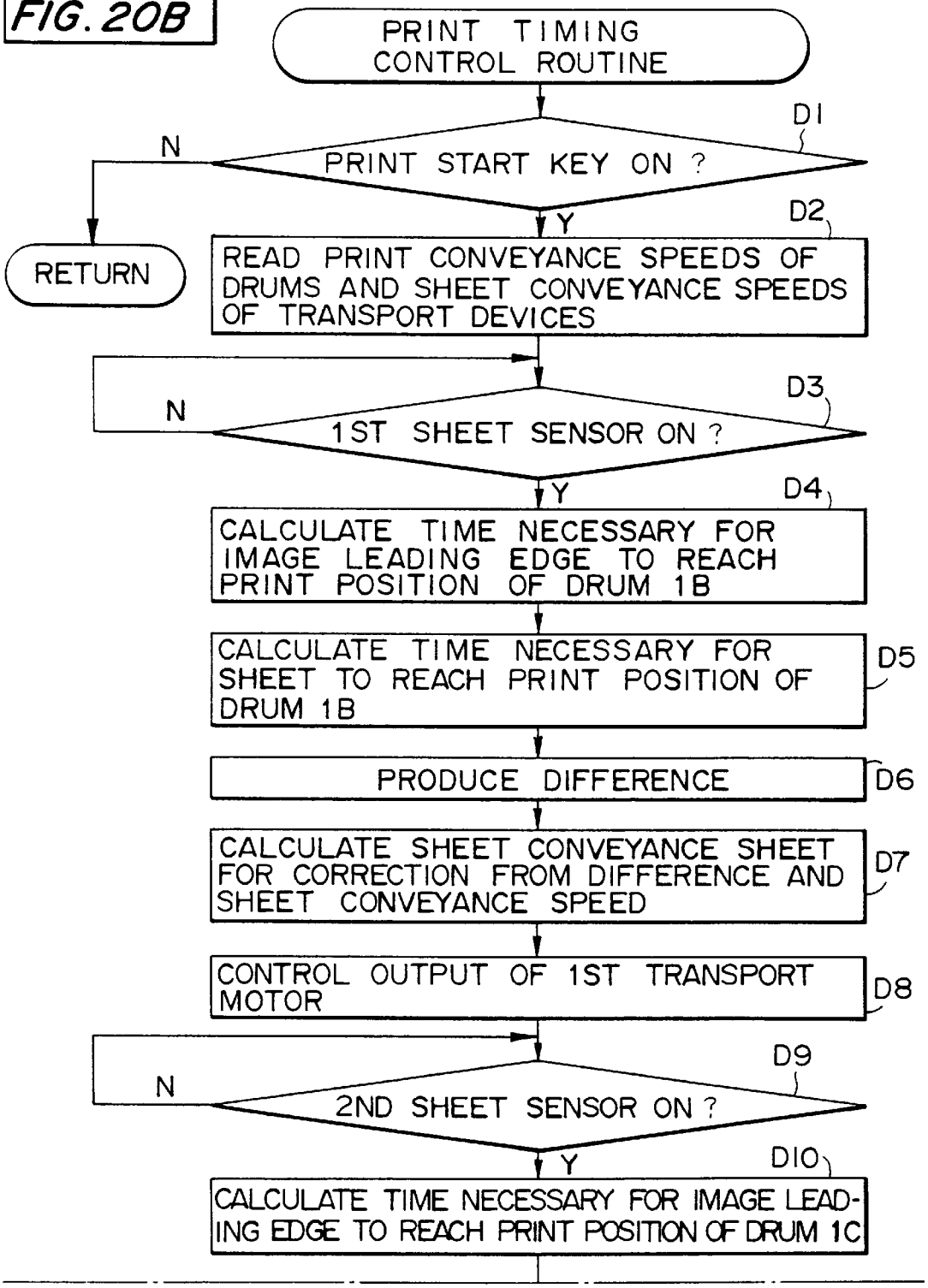
FIG. 20 is a flowchart demonstrating a print timing control routine particular to the fourth embodiment.
Figure 20B:
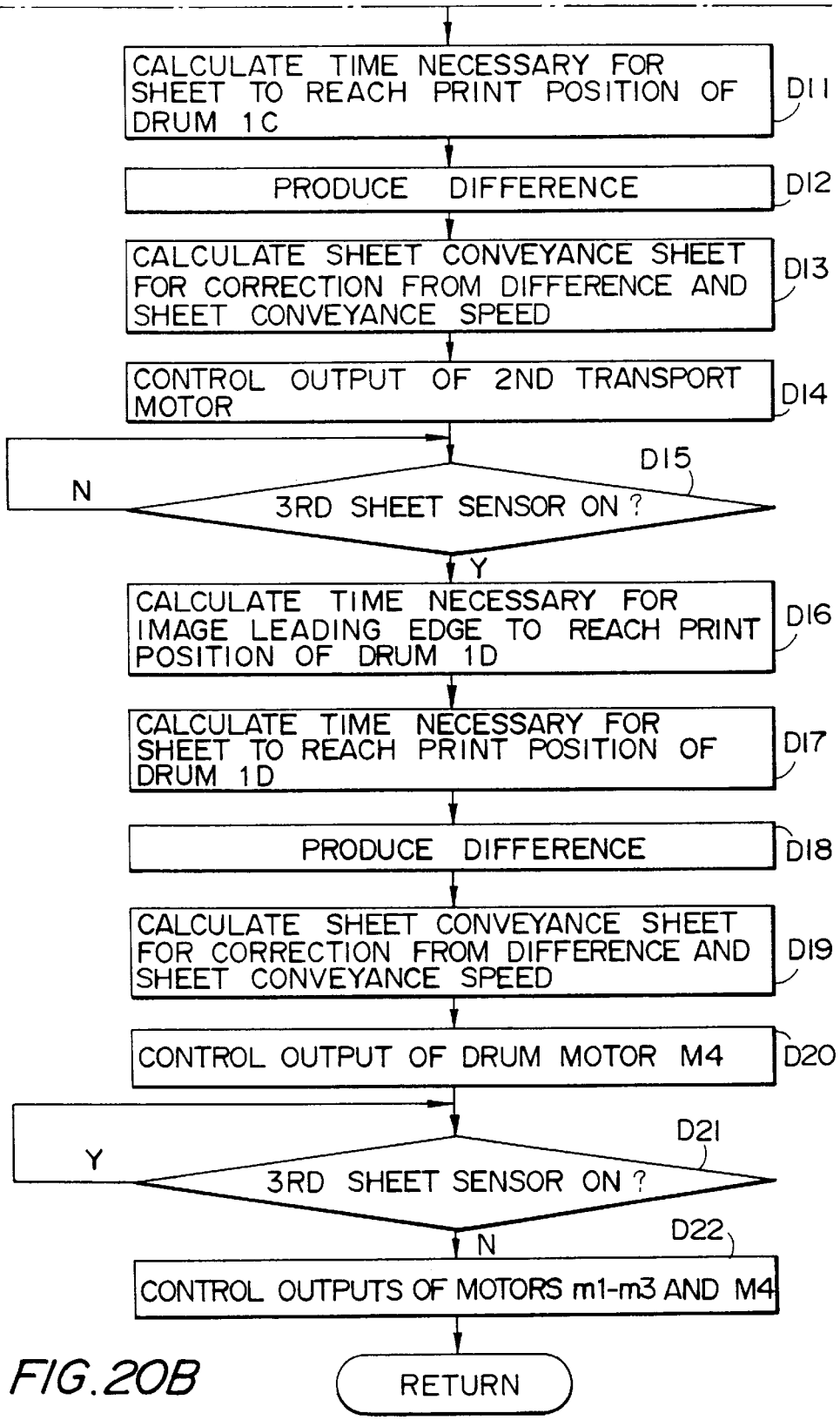

FIGS. 18–20 show a fourth embodiment of the present invention. As shown, this embodiment includes a third unit U3 and a fourth unit U4 in addition to the first and second units U1 and U2 of the first embodiment. Because the first to fourth units U1–U4 are identical in configuration, let the third and fourth units U3 and U4 be simply distinguished from the first unit U1 by suffixes c and d, respectively.

As shown in FIG. 18, four drums 1A, 1B, 1C and 1D are arranged in an array from the upstream side to the downstream side in the sheet conveyance direction X at preselected intervals. Ink of particular color is fed to each of the drums 1A–1D. Intermediate transport devices 17*a*, 17*b* and 17*c* are respectively arranged between the drums 1A and 1B, between the drums 1B and 1C, and between the drums 1C and 1D. A control means 120 shown in FIG. 19 controls the sheet feed timing of each of the intermediate transport devices 17*a*–17*c* and the rotation speed Vd of the drum 1D which is a print conveyance speed.

In the illustrative embodiment, yellow ink, magenta ink, cyan ink and black ink are respectively fed to the drums 1A, 1B, 1C and 1D in order to implement full-color printings.

Masters 33*c* and 32*d* produced by the same procedure as in the first embodiment are respectively wrapped around the drums 1C and 1D and held by dampers 5*c* and 5*d*. Motors M1, M2, M3 and M4 are respectively connected to the drums 1A, 1B, 1C and 1D via respective drivelines not shown. Identical rotation speeds or conveyance speeds Va, Vb, Vc and Vd are initially assigned to the drums 1A, 1B, 1C and 1D.

Pressing devices 32*c* and 32*d* including press rollers 9*c* and 9*d*, respectively, are positioned below the drums 1C and 1D, respectively. Printing positions E3 and E4 are respectively defined between the drum 1C and the pressing device 32*c* and between the drum 1D and the pressing device 32*d*. The press rollers 9*c* and 9*d* each presses the sheet 22 brought thereto by the intermediate transport device 17*b* or 17*c* against the associated drum 1C or 1D, so that an image is transferred from the drum 1C or 1D to the sheet 22.

The intermediate transport devices 17*a*, 17*b* and 17*c* are respectively located between the print positions E1 and E2, between the print positions E2 and E3, and between the print positions E3 and E4. The device 17*b* includes a drive roller 15*b*, a driven roller 14*b*, a porous belt 16*b* passed over the rollers 14*b* and 15*b*, and a suction fan 18*b*. Likewise, the device 17*c* includes a drive roller 15*c*, a driven roller 14*c*, a porous belt 16*c* passed over the rollers 14*c* and 15*c*, and a suction fan 18*c*.

The drive rollers 15*a*, 15*b* and 15*c* are respectively connected to a first, a second and a third motor m1,m2 and m3 via respective drivelines (not shown) and driven in the direction X thereby. The motors m1–m3 each is implemented by a stepping motor and has its rotation speed increased or decreased in terms of a frequency fed thereto. Belt speed sensors or conveyance speed sensing means 121, 122 and 123 are respectively mounted on the shafts (not shown) of the drive rollers 15*a*, 15*b* and 15*c* in order to sense the peripheral speeds or sheet conveyance speeds $V_1$, $V_2$ and $V_3$ of the belts 16*a*, 16*b* and 16*c*, respectively. The sensors 121–123 each is implemented by a conventional rotary encoder.

Sheet sensors or leading edge sensing means 124, 125 and 126 are respectively positioned above the belts 16*a*, 16*b* and 16*c* in order to sense the leading edge of the sheet 22 being conveyed. The sheet sensors 124–126 are conventional reflection type sensors, and each has a light emitting element and a light-sensitive element arranged to face the associated belt 16*a*, 16*b* or 16*c*. As shown in FIG. 19, the sheet sensors 124–126 are electrically connected to control means 120 and feed their outputs to the control means 120 while sensing the sheet 22 being conveyed. In this embodiment, the sheet feeding device 20 also has the sheet tray 2 not including the sheet size sensors 46 and 56.

The control means 120 is also implemented as a conventional microcomputer including a CPU 127, an I/O port, not shown, a ROM 128, and a RAM 129 which are interconnected by a signal bus not shown.

The CPU 127 is connected to drum speed sensors 130, 131 and 132 respectively responsive to the rotation speeds Vb–Vd of the drums 1B–1D, belt speed sensors 121, 122 and 123, the conveyance speed select key 50 and speed adjust key 78 playing the role of conveyance speed selecting means which allows the peripheral speeds $V_1$–$V_3$ to be set by the operator, and the print speed select key 79. The print speed select key 79 and speed adjust key 78 constitute print conveyance speed selecting means which allows the rotation speed Vd of the drum 1D to be set by the operator. In this embodiment, the peripheral speed V1 of the belt 16*a* is selected to be about 1.2 times as high as the rotation speed Va of the most upstream drum 1A.

The drum speed sensors 130–132 are implemented by conventional rotary encoders respectively mounted on the output shafts (not shown) of the drum motors M2–M4 and feed their outputs to the CPU 127. The control means 120 causes the drum motor M1 to start rotating in synchronism with the registration timing of the registration rollers 29 and 30.

Further, the CPU 127 is connected to the numeral keys 71, print start key 72, perforation start key 73, stop key 74, display 75, monitor display 76 and clear key 77 arranged on the operation panel 70, the conveyance speed select key 50 for giving priority to manual speed setting, the print speed select key 79 for giving priority to manual print conveyance speed setting relating to the drum 1D, and the speed adjust key 78, i.e., down key 78*a* and up key 78*b* for allowing the rotation speeds of the motors m1–m3 and the rotation speed of the drum motor M4 to be varied stepwise.

In addition, the CPU 127 is electrically connected to the master make and feed drive 83, master discharge drive 84, sheet feed drive 85, pressure drive 86, sheet discharge drive 87 and fan drive 88 so as to interchange command signals and/or ON/OFF signals and data signals therewith, thereby controlling the entire system including the starts and stops of operation and timings.

The motors m1–m3 are connected to the CPU 127 via drive circuits 133. The belt speed sensors 121–123 respectively sense the operating conditions of the motors m1–m3, i.e., the peripheral speeds $V_1$–$V_3$ of the belts 16*a*–16*c* and send their outputs to the CPU 127 via pulse detectors 135.

The drum motors M2, M3 and M4 are connected to the CPU 127 via drivers 134*b*, 134*c* and 134*d*, respectively. Drum speed sensors 130–132 respectively sense the operation conditions of the motors M2–M4, i.e., the rotation speeds Vb–Vd of the drums 1B–1D and send their outputs to the CPU 127 via pulse detectors 136*a*, 136*b* and 136*c*. The drum motor M1 is connected to the CPU 127 via a driver 134*a*.

The control means 120 writes data received from the sensors and the results of calculations output from the CPU 127 in the RAM 129 for a moment and reads them out adequately. The ROM 128 stores a program and data relating to the starts, stops and timings of the various devices and drive sections, distance data g1, g2 and g3 respectively representative the distance between the sheet sensor 124 and the center of the print position E2, the distance between the sheet sensor 125 and the center of the print position E3, and the distance between the sheet sensor 126 and the center of the print position E4, and a print timing control routine shown in FIG. 20. In the illustrative embodiment, the CPU 127 includes a corrected speed calculation 137 serving as a sheet conveyance control section and a print conveyance control section at the same time. The corrected speed calculation 137 calculates, by using the ON outputs of the sheet sensors 124–126 as triggers, peripheral speeds $V_1$ and $V_2$ of the belts 16*a* and 16*b* which allow the leading edges of the images on the drums 1B and 1C and the leading edge of the sheet 22 to meet at the print positions E2 and E3, respectively, and a rotation speed Vd of the drum 1D which allows the leading edge of the image on the drum 1D and the leading edge of the sheet 22 to meet at the print position E4.

Print timing control particular to this embodiment will be described with reference to FIG. 20. As shown, the control means 120 determines whether or not the print start key 72 is in its ON state (step D1). If the answer of the step D1 is Yes, the control means 120 drives the various sections of the printer. As a result, the drums 1A–1D and belts 16*a*–16*c* each is rotated at a constant speed while the sheet 22 is fed from the sheet feeding device 20 toward the print position E1 at a preselected timing. At the same time, the press rollers 9*a*–9*d* are brought into contact with the drums 1A–1D, respectively. The sheet 22 with a yellow image printed thereon at the print position E1 is transported toward the print position E2 by the belt 16*a* while being retained thereon by suction.

The control means 120 writes the rotation speeds Vb–Vd of the drums 1B–1D and the peripheral speeds $V_1$–$V_3$ of the belts 16*a*–16*c* respectively represented by the outputs of the drum speed sensors 130–132 and belt speed sensors 121–123 in the RAM 129 (step D2). Then, the control means 120 determines whether or not the most upstream sheet sensor 124 has sensed the leading edge of the sheet 22 (step D3). At the time when the sheet sensor 124 senses the leading edge of the sheet 22 (Yes, step D3), the control means 120 determines the position of the leading edge of the image on the drum 1B on the basis of the output of the drum speed sensor 124, and calculates a period of time necessary for the leading edge to reach the print position E2 (step D4).

After the step D4, the control means 120 reads the distance data g1 representative of the distance between the sheet sensor 124 and the center of the print position E2 out of the ROM 128. Then, the control means 120 calculates a period of time necessary for the leading edge of the sheet 22 to reach the print position E2 by using the distance data g1 and the peripheral speed $V_1$ of the belt 16*a* stored in the RAM 129. These steps are collectively represented by a step D5. Subsequently, the control means 120 produces a difference between the periods of time calculated in the steps D4 and D5 (step D6).

The control means 120 calculates, based on the difference produced in the step D6 and the peripheral speed $V_1$ of the belt 16*a*, a peripheral speed of the belt 16*a* which is a sheet conveyance speed for correction (step D7). Then, the control means 120 varies the frequency meant for the motor m1 until the peripheral speed $V_1$ of the belt 16*a* coincides with the sheet conveyance speed for correction (step D8). Specifically, the control means 120 raises the peripheral speed $V_1$ if the arrival of the sheet 22 at the print position E2 will be delayed, or lowers it if the arrival will be advanced. Because the sheet 22 is conveyed toward the print position E2 under such speed control, the leading edge of a magenta image on the drum 1B is transferred to the sheet 22 in accurate register with the leading edge of the yellow image existing on the sheet 22. After the sheet 22 has been peeled off from the drum 1B by the air knife 7*b*, it is further conveyed to the downstream side by the belt 16*b*.

The control means 120 determines whether or not the sheet sensor 125 has sensed the leading edge of the sheet 22 (step D9). At the time when the sheet sensor 125 senses the leading edge of the sheet 22 (Yes, step D9), the control means 120 determines the position of the leading edge of the image on the drum 1C on the basis of the output of the drum speed sensor 131, and calculates a period of time necessary for the leading edge to reach the print position E3 (step D10).

After the step D10, the control means 120 reads the distance data g2 representative of the distance between the sheet sensor 125 and the center of the print position E3 out of the ROM 128. Then, the control means 120 calculates a period of time necessary for the leading edge of the sheet 22 to reach the print position E3 by using the distance data g2 and the peripheral speed $V_2$ of the belt 16*b* stored in the RAM 129. These steps are collectively represented by a step D11. Subsequently, the control means 120 produces a difference between the periods of time calculated in the steps D10 and D11 (step D12).

The control means 120 calculates, based on the difference produced in the step D12 and the peripheral speed $V_2$ of the belt 16*b*, a peripheral speed of the belt 16*b* which is a sheet conveyance speed for correction (step D13). Then, the control means 120 varies the frequency meant for the motor m2 until the peripheral speed $V_2$ of the belt 16*b* coincides with the sheet conveyance speed for correction (step D14). Specifically, the control means 120 raises the peripheral speed $V_2$ if the arrival of the sheet 22 at the print position E3 will be delayed, or lowers it if the arrival will be advanced. Because the sheet 22 is conveyed toward the print position E3 under such speed control, the leading edge of a cyan image on the drum 1C is transferred to the sheet 22 in accurate register with the leading edge of the composite yellow and magenta image existing on the sheet 22. After the sheet 22 has been peeled off from the drum 1C by the air knife 7*c*, it is further conveyed to the downstream side by the belt 16*c*.

The control means 120 determines whether or not the sheet sensor 126 has sensed the leading edge of the sheet 22 (step D15). At the time when the sheet sensor 126 senses the leading edge of the sheet 22 (Yes, step D15), the control means 120 determines the position of the leading edge of the image on the drum 1D on the basis of the output of the drum speed sensor 132, and calculates a period of time necessary for the leading edge to reach the print position E4 (step D16).

After the step D16, the control means 120 reads the distance data g3 representative of the distance between the sheet sensor 126 and the center of the print position E4 out of the ROM 128. Then, the control means 120 calculates a period of time necessary for the leading edge of the sheet 22 to reach the print position E4 by using the distance data g3 and the peripheral speed $V_3$ of the belt 16*c* stored in the RAM 129. These steps are collectively represented by a step D17. Subsequently, the control means 120 produces a difference between the periods of time calculated in the steps D16 and D17 (step D18).

The control means 120 calculates, based on the difference produced in the step D18 and the rotation speed Vd of the drum 1D, a rotation speed of the drum 1D which is a print conveyance speed for correction (step D19). Then, the control means 120 varies the frequency meant for the drum motor M4 until the rotation speed Vd of the drum 1D coincides with the print conveyance speed for correction (step D20). Specifically, the control means 120 lowers the rotation speed Vd if the arrival of the sheet 22 at the print position E4 will be delayed, or raises it if the arrival will be advanced.

After the step D20, the control means 120 determines whether or not the sheet sensor 126 is still in its ON state (step D21). When a preselected period of time elapses since the turn-off of the sheet sensor 126 (No, step D21), the control means 120 determines that the sheet 22 has disappeared from the belt 16*c*. Subsequently, the control means 120 so controls the motors m1–m3 as to restore the previous or initial peripheral speeds $V_1$–$V_3$ of the belts 16*a*–16*c*, controls the drum motor M4 to restore the previous or initial rotation speed Vd of the drum 1D, and prepares for the next sheet 22 (step D22). If desired, the steps D4 and D5 may be replaced with each other, the steps D11 and D12 may be replaced with each other and the steps D16 and D17 may be replaced with each other.

In the illustrative embodiment, the peripheral speeds of the belts 16*a*–16*c* each is restored to the initial peripheral speed after correction. Alternatively, the corrected peripheral speeds themselves may be corrected without being restored to the initial speeds. After the control, the peripheral speeds will be restored to their initial speeds.

Because the sheet 22 on the belt 16*c* is conveyed toward the print position E4 under such speed control, the leading edge of a black image on the drum 1D is transferred to the sheet 22 in accurate register with the leading edge of the composite yellow, magenta and cyan image existing on the sheet 22, producing a full-color printing. The sheet 22 moved away from the print position E4 is peeled off from the drum 1D by the air knife 7*d* and driven out to the printing tray 37 by the belt 40.

As stated above, this embodiment controls the consecutive timings for feeding the sheet 22 to the print positions E2 and E3, and the timing for feeding the leading edge of the image on the drum 1D to the print position E4. Therefore, even when the landing point (conveyance start point) of the sheet 22 on any one of the belts 16*a*–16*c* is disturbed by irregularity in the timing for the sheet 22 to be separated from associated one of the drums 1B–1D, this embodiment is capable of surely matching the leading edge of the image printed on the sheet 22 and the leading edge of the image on the drum at associated one of the print positions E2–E4. This obviates double printing and misregister.

The peripheral speeds $V_1$–$V_3$ of the belts 16*a*–16*c* and the rotation speed Vd of the drum 1D are controlled by using the ON outputs of the sheet sensors 124–126 as triggers, as stated earlier. This makes it needless to set or sense a sheet size or to store sheet data and thereby simplifies the construction while reducing a load on a memory. The illustrative embodiment restores the belts 16*a* and 16*b* and drum 1D to their initial speeds as soon as the sheet 22 disappears from the belt 16*c*, as stated earlier. Therefore, when any one of the peripheral speeds of the belts 16*a* and 16*b* and the rotation speed of the drum 1D is increased for correction, the wasteful power consumption of associated one of the motors m1 and m2 and M4 is obviated. This contributes to the energy saving of the printer. This control is particularly effective when applied to a printer of the type including a plurality of intermediate transport devices, i.e., many drive sections consuming great power.

When the operator presses the conveyance speed select key 50 or the print speed select key 79, the control routine shown in FIG. 20 can be executed by an interrupt. This, coupled with the fact that the operator can vary the frequencies meant for the motors m1–m3 and M4 on the speed adjust key 78, allows the operator to adjust the peripheral speeds $V_1$–$V_3$ of the belts 16*a*–16*c* and the rotation speed Vd of the drum 1D if a printing produced by the routine of FIG. 20 is out of register.

In the illustrative embodiment, the rotation speed Va of the drum 1A and the peripheral speed $V_1$ of the belt 16*a* are equal to each other. Alternatively, the peripheral speed $V_1$ may be selected to be about 1.2 times as high as the rotation speed Va, as in the first embodiment, so as to prevent the basic timing for feeding the sheet 22 to the print position E2 from being delayed. Moreover, assume that the size or the coefficient of friction of the sheet 22 or the viscosity of the ink is varied due to humidity or temperature, preventing the belts 16*a*–16*c* moving at their initial peripheral speeds $V_1$–$V_3$ from feeding the sheet 22 to the consecutive print positions E2–E4 at the expected timings. Even in such a condition, it is possible to control the peripheral speeds of the belts and therefore the above timings by using the routine shown in FIG. 20. This obviates double printing or misregister more positively.

The illustrative embodiment may be implemented as a six-color stencil printer including two additional drums following the most downstream drum 1D and respectively feeding, e.g., gold ink and silver ink to masters wrapped therearound. With such a printer, it is possible to implement a broader range of color printings. Of course, the arrangements and control particular to the above embodiment will also be applied to the six-color stencil printer in order to obviate double printing and misregister.

In the above embodiment, the peripheral speeds $V_1$–$V_3$ of the belts 16*a*–16*c* and the rotation speed Vd of the drum 1D are controlled on the basis of the outputs of the sheet sensors 124–126. Alternatively, the sheet conveyance speeds of the belts 16*a*–16*c* and the print conveyance speed of the drum 1D may be controlled on the basis of a sheet size, as in the first embodiment, or the combination of the sheet size and the leading edge of a sheet.

In summary, it will be seen that the present invention provides a stencil printer having various unprecedented advantages as enumerated below.

(1) The timing for transferring an image from a master wrapped around a downstream drum to a sheet carrying an image transferred from an upstream drum can be adjusted in order to allow a minimum of double printing and misregister to occur.

(2) The timing for feeding the sheet carrying the image transferred from the upstream drum to the downstream drum can be adequately adjusted in order to allow a minimum of double printing and misregister to occur.

(3) Even when the conveyance of the sheet from the upstream drum to the downstream drum is delayed, the delay can be made up for by the operating speed of an intermediate transport device. This is particularly effective to reduce double printing.

(4) The timing at which the downstream drum and a sheet meet each other can be adjusted on the basis of the position of sensing means responsive to the leading edge of the sheet.

(5) At a print position assigned to the downstream drum, the sheet can be brought into register with the master wrapped around the drum without resorting to control over the transport speed of the intermediate transport device, allowing a minimum of double printing and misregister to occur while reducing a control time. In addition, even when the sheet is fed to the downstream drum earlier than expected, the transport speed of the intermediate transport device is controlled on the basis of the leading edge of the sheet. Therefore, it is possible to control the image transfer timing from the master of the downstream drum to the sheet more delicately, thereby reducing double printing and misregister more positively.

(6) Even when printing by the upstream drum or sheet transport by the intermediate transport device is delayed, the delay can be corrected by the adjustment of the print conveyance speed of the downstream drum, allowing a minimum of double printing and misregister to occur.

(7) At the print position assigned to the downstream drum, the sheet can be brought into register with the master wrapped around the drum without resorting to continuous control over the print conveyance speed of the downstream drum, allowing a minimum of double printing and misregister to occur while reducing a control time. In addition, even when the sheet is fed to the downstream drum earlier than expected, the print conveyance speed of the downstream drum is controlled on the basis of the leading edge of the sheet. Therefore, it is possible to control the image transfer timing from the master of the downstream drum to the sheet more delicately, thereby reducing double printing and misregister more positively.

(8) It is not necessary to set a particular sheet conveyance speed or a print conveyance speed for each sheet size. In addition, the timing for the sheet to arrive at the downstream drum can be adjusted even when the sheet size is changed. This reduces double printing and misregister to a noticeable degree and reduces wasteful printing ascribable to erroneous settings.

(9) The timing for a relatively short sheet to arrive at the downstream drum can be adequately adjusted in order to allow a minimum of double printing and misregister to occur.

(10) The intermediate transport device or the downstream drum can be moved at a sheet conveyance speed or a print conveyance speed selected by the operator.

Various modifications will become possible for those skilled in the art after receiving the teachings of the present disclosure without departing from the scope thereof.

What is claimed is:

1. A stencil printer comprising:

a plurality of drums arranged side by side in an intended direction of sheet conveyance at a preselected interval, each of said plurality of drums being configured to wrap a respective master around an outer periphery thereof and including an ink feeding device which is disposed inside each respective drum and which is configured to feed ink of a particular color to an inner periphery of the respective drum;

an intermediate transport device arranged between said plurality of drums and configured to convey a sheet with an image printed by an upstream drum of said plurality of drums in the intended direction of sheet conveyance toward a downstream drum of said plurality of drums; and a controller configured to calculate and to adjust a timing for transferring the sheet from said intermediate transport device to said downstream drum.

2. A stencil printer as claimed in claim 1, wherein said controller is configured to adjust said timing by controlling a timing for causing said intermediate transport device to feed the sheet to said downstream drum.

3. A stencil printer as claimed in claim 2, wherein a sheet conveyance speed of said intermediate transport device is higher than a print conveyance speed of said upstream drum.

4. A stencil printer as claimed in claim 3, further comprising a leading edge sensing device configured to sense a leading edge of the sheet, wherein said controller includes a sheet conveyance control section configured to control the sheet conveyance speed of said intermediate transport device in accordance with an output of said leading edge sensing device.

5. A stencil printer as claimed in claim 4, wherein said sheet conveyance control section is configured to control the sheet conveyance speed of said intermediate transport device such that after said leading edge sensing device has sensed the leading edge of the sheet, the sheet and the master wrapped around said downstream drum meet each other at a print position assigned to said downstream drum.

6. A stencil printer as claimed in claim 3, wherein said controller is configured to control a print conveyance speed of said downstream drum.

7. A stencil printer as claimed in claim 6, further comprising a leading edge sensing device configured to sense a leading edge of the sheet, wherein said controller includes a print conveyance speed control section configured to control said print conveyance speed of said downstream drum.

8. A stencil printer as claimed in claim 7, wherein said print conveyance speed control section is configured to control the print conveyance speed of said downstream drum such that after said leading edge sensing device has sensed the leading edge of the sheet, the sheet and the master wrapped around said downstream drum meet each other at a print position assigned to said downstream drum.

9. A stencil printer as claimed in claim 8, further comprising a size sensing device configured to sense a size of the sheet, wherein said controller is configured to control at least one of a sheet conveyance speed of said intermediate transport device and the print conveyance speed of said downstream drum in accordance with the size sensed by said size sensing device.

10. A stencil printer as claimed in claim 9, wherein when a length of the sheet in the intended direction of sheet conveyance is smaller than a distance between a print position of said upstream drum and a print position of said downstream drum, said controller is configured to equalize the sheet conveyance speed of said intermediate transport device and a print conveyance speed of said upstream drum.

11. A stencil printer as claimed in claim 10, further comprising at least one of a sheet conveyance speed selecting device configured to allow an operator to select a sheet conveyance speed of the sheet, and a print conveyance speed selecting device configured to allow the operator to select a print conveyance speed of said downstream drum, wherein said controller is configured to control either the sheet conveyance speed or the print conveyance speed in response to a select signal output from at least one of said sheet conveyance speed selecting device and said print conveyance speed selecting device.

12. A stencil printer as claimed in claim 6, further comprising a size sensing device configured to sense a size of the sheet, wherein said controller is configured to control at least one of a sheet conveyance speed of said intermediate transport device and the print conveyance speed of said downstream drum in accordance with the size sensed by said size sensing device.

13. A stencil printer as claimed in claim 12, wherein when a length of the sheet in the intended direction of sheet conveyance is smaller than a distance between a print position of said upstream drum and a print position of said downstream drum, said controller is configured to equalize the sheet conveyance speed of said intermediate transport device and a print conveyance speed of said upstream drum.

14. A stencil printer as claimed in claim 13, further comprising at least one of a sheet conveyance speed selecting device configured to allow an operator to select a sheet conveyance speed of the sheet, and a print conveyance speed selecting device configured to allow the operator to select a print conveyance speed of said downstream drum, wherein said controller is configured to control either the sheet conveyance speed or the print conveyance speed in response to a select signal output from at least one of said sheet conveyance speed selecting device and said print conveyance speed selecting device.

15. A stencil printer as claimed in claim 2, further comprising a leading edge sensing device configured to sense a leading edge of the sheet, wherein said controller includes a sheet conveyance control section configured to control the sheet conveyance speed of said intermediate transport device in accordance with an output of said leading edge sensing device.

16. A stencil printer as claimed in claim 15, wherein said sheet conveyance control section is configured to control the sheet conveyance speed of said intermediate transport device such that after said leading edge sensing device has sensed the leading edge of the sheet, the sheet and the master wrapped around said downstream drum meet each other at a print position assigned to said downstream drum.

17. A stencil printer as claimed in claim 2, wherein said controller is configured to control a print conveyance speed of said downstream drum.

18. A stencil printer as claimed in claim 17, further comprising a leading edge sensing device configured to sense a leading edge of the sheet, wherein said controller includes a print conveyance speed control section configured to control a print conveyance speed of said downstream drum.

19. A stencil printer as claimed in claim 18, wherein said print conveyance speed control section is configured to control the print conveyance speed of said downstream drum such that after said leading edge sensing device has sensed the leading edge of the sheet, the sheet and the master wrapped around said downstream drum meet each other at a print position assigned to said downstream drum.

20. A stencil printer as claimed in claim 19, further comprising a size sensing device configured to sense a size of the sheet, wherein said controller is configured to control at least one of a sheet conveyance speed of said intermediate transport device and the print conveyance speed of said downstream drum in accordance with the size sensed by said size sensing device.

21. A stencil printer as claimed in claim 20, wherein when a length of the sheet in the intended direction of sheet conveyance is smaller than a distance between a print position of said upstream drum and a print position of said downstream drum, said controller is configured to equalize the sheet conveyance speed of said intermediate transport device and a print conveyance speed of said upstream drum.

22. A stencil printer as claimed in claim 21, further comprising at least one of a sheet conveyance speed selecting device configured to allow an operator to select a sheet conveyance speed of the sheet, and a print conveyance speed selecting device configured to allow the operator to select a print conveyance speed of said downstream drum, wherein said controller is configured to control either the sheet conveyance speed or the print conveyance speed in response to a select signal output from at least one of said sheet conveyance speed selecting device and said print conveyance speed selecting device.

23. A stencil printer as claimed in claim 2, further comprising a size sensing device configured to sense a size of the sheet, wherein said controller is configured to control at least one of a sheet conveyance speed of said intermediate transport device and a print conveyance speed of said downstream drum in accordance with the size sensed by said size sensing device.

24. A stencil printer as claimed in claim 23, wherein when a length of the sheet in the intended direction of sheet conveyance is smaller than a distance between a print position of said upstream drum and a print position of said downstream drum, said controller is configured to equalize the sheet conveyance speed of said intermediate transport device and a print conveyance speed of said upstream drum.

25. A stencil printer as claimed in claim 24, further comprising at least one of a sheet conveyance speed selecting device configured to allow an operator to select a sheet conveyance speed of the sheet, and a print conveyance speed selecting device configured to allow the operator to select a print conveyance speed of said downstream drum, wherein said controller is configured to control either the sheet conveyance speed or the print conveyance speed in response to a select signal output from at least one of said sheet conveyance speed selecting device and said print conveyance speed selecting device.

26. A stencil printer as claimed in claim 1, wherein said controller is configured to adjust said timing by controlling a print conveyance speed of said downstream drum.

27. A stencil printer as claimed in claim 26, further comprising a leading edge sensing device configured to sense a leading edge of the sheet, wherein said controller includes a print conveyance speed control section configured to control said print conveyance speed of said downstream drum.

28. A stencil printer as claimed in claim 27, wherein said print conveyance speed control section is configured to control the print conveyance speed of said downstream drum such that after said leading edge sensing device has sensed the leading edge of the sheet, the sheet and the master wrapped around said downstream drum meet each other at a print position assigned to said downstream drum.

29. A stencil printer as claimed in claim 28, further comprising a size sensing device configured to sense a size of the sheet, wherein said controller is configured to control at least one of a sheet conveyance speed of said intermediate transport device and the print conveyance speed of said downstream drum in accordance with the size sensed by said size sensing device.

30. A stencil printer as claimed in claim 29, wherein when a length of the sheet in the intended direction of sheet conveyance is smaller than a distance between a print position of said upstream drum and a print position of said downstream drum, said controller is configured to equalize the sheet conveyance speed of said intermediate transport device and a print conveyance speed of said upstream drum.

31. A stencil printer as claimed in claim 30, further comprising at least one of a sheet conveyance speed selecting device configured to allow an operator to select a sheet conveyance speed of the sheet, and a print conveyance speed selecting device configured to allow the operator to select a print conveyance speed of said downstream drum, wherein said controller is configured to control either the sheet conveyance speed or the print conveyance speed in response to a select signal output from at least one of said sheet conveyance speed selecting device and said print conveyance speed selecting device.

32. A stencil printer as claimed in claim 1, further comprising a size sensing device configured to sense a size of the sheet, wherein said controller is configured to control at least one of a sheet conveyance speed of said intermediate transport device and a print conveyance speed of said downstream drum in accordance with the size sensed by said size sensing device.

33. A stencil printer as claimed in claim 32, wherein when a length of the sheet in the intended direction of sheet conveyance is smaller than a distance between a print position of said upstream drum and a print position of said downstream drum, said controller is configured to equalize the sheet conveyance speed of said intermediate transport device and a print conveyance speed of said upstream drum.

34. A stencil printer as claimed in claim 33, further comprising at least one of a sheet conveyance speed selecting device configured to allow an operator to select a sheet conveyance speed of the sheet, and a print conveyance speed selecting device configured to allow the operator to select a print conveyance speed of said downstream drum, wherein said controller is configured to control either the sheet conveyance speed or the print conveyance speed in response to a select signal output from at least one of said sheet conveyance speed selecting device and said print conveyance speed selecting device.

* * * * *